US006130688A

United States Patent [19]

Agarwal et al.

[11] Patent Number: 6,130,688

[45] Date of Patent: Oct. 10, 2000

[54] HIGH EFFICIENCY ORIFICE PLATE STRUCTURE AND PRINTHEAD USING THE SAME

[75] Inventors: Arun K Agarwal, Corvallis, Oreg.; Kit C Baughman, Boise, Id.; Jennifer M. Korngiebel, Escondido, Calif.; Neal W. Meyer, Corvallis, Oreg.; Harold Lee Van Nice, Corvallis, Oreg.; Salim Khasawinah, Corvallis, Oreg.

[73] Assignee: Hewlett-Packard Company, Palo Alto, Calif.

[21] Appl. No.: 09/393,845

[22] Filed: Sep. 9, 1999

[51] Int. Cl.[7] ..... B41J 2/14; B41J 2/05

[52] U.S. Cl. ..... 347/47; 347/63

[58] Field of Search ..... 347/63, 65, 44, 347/47

[56] References Cited

U.S. PATENT DOCUMENTS

| | | | |
|---|---|---|---|
| 3,823,408 | 7/1974 | Gordon, III | 346/14 |
| 4,246,076 | 1/1981 | Gardner | 204/11 |
| 4,329,698 | 5/1982 | Smith . | |
| 4,389,654 | 6/1983 | Bar-on et al. | 346/77 |
| 4,500,895 | 2/1985 | Buck et al. . | |
| 4,535,343 | 8/1985 | Wright et al. | 347/63 |
| 4,587,534 | 5/1986 | Saito et al. . | |
| 4,616,408 | 10/1986 | Lloyd . | |
| 4,675,083 | 6/1987 | Bearss et al. | 204/11 |
| 4,749,291 | 6/1988 | Kobayashi et al. . | |
| 4,771,295 | 9/1988 | Baker et al. . | |
| 4,944,850 | 7/1990 | Dion . | |
| 5,122,812 | 6/1992 | Hess et al. . | |
| 5,185,034 | 2/1993 | Webb et al. . | |
| 5,278,584 | 1/1994 | Keefe et al. . | |
| 5,305,015 | 4/1994 | Schantz et al. . | |
| 5,417,897 | 5/1995 | Asakawa et al. | 264/22 |
| 5,451,993 | 9/1995 | Takahashi et al. | 347/47 |
| 5,786,830 | 7/1998 | Su et al. . | |

FOREIGN PATENT DOCUMENTS

| | | | |
|---|---|---|---|
| 0419190A2 | 9/1990 | European Pat. Off. | B41J 2/16 |
| 62-68763 | 3/1988 | Japan . | |
| 2-281959 | 11/1990 | Japan . | |

OTHER PUBLICATIONS

Hewlett–Packard Journal, vol. 39, No. 4 (Aug. 1988).

*Primary Examiner*—N. Le
*Assistant Examiner*—Juanita Stephens

[57] ABSTRACT

A novel polymeric orifice plate for a printhead. The plate includes a recess in the top surface thereof which terminates at a position between the top and bottom plate surfaces. The recess communicates with a bore which passes through the remainder of the plate and terminates at the bottom surface thereof. The recess has an upper end with a first opening therein, a lower end with a second opening therein, and a side wall which is preferably oriented at a right angle relative to the top surface of the plate. The recess may also have a bottom wall at the lower end. The first opening is larger than the second opening. The application of physical force to the plate does not disturb the second opening in the recess which is "inset" and protected. This design insures proper ink drop trajectory and the generation of high-quality printed images.

1 Claim, 7 Drawing Sheets

HIGH EFFICIENCY ORIFICE PLATE STRUCTURE AND PRINTHEAD USING THE SAME

BACKGROUND OF THE INVENTION

The present invention generally relates to printhead structures for use in delivering ink to a substrate, and more particularly to a novel orifice plate designed for attachment to a printhead. The orifice plate includes a number of important structural features which enable high print quality levels to be maintained over the life of the printhead.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in U.S. Pat. Nos. 4,500,895 to Buck et al.; 4,771,295 to Baker et al.; 5,278,584 to Keefe et al.; and the *Hewlett-Packard Journal,* Vol. 39, No. 4 (August 1988), all of which are incorporated herein by reference.

The ink delivery systems described above (and comparable printing units using thermal inkjet and other ink ejection technologies) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit is provided at a remote location within the printer, with the ink containment unit being operatively connected to and in fluid communication with the printhead using one or more ink transfer conduits. These particular systems are conventionally known as "off-axis" printing units. Representative, non-limiting off-axis ink delivery systems are discussed in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 11, 1997) entitled "REGULATOR FOR A FREE-INK INKJET PEN" (Hauck et al.) which are each incorporated herein by reference. The present invention (as discussed below) is applicable to both on-board and off-axis systems which will become readily apparent from the discussion provided herein.

In order to effectively deliver ink materials to a selected substrate, thermal inkjet printheads typically include an outer plate member known as a "nozzle plate" or "orifice plate" which includes a plurality of ink ejection orifices (e.g. openings or bores) therethrough. Initially, these orifice plates were manufactured from one or more metallic compositions including but not limited to gold-plated or palladium-plated nickel and similar materials. However, recent developments in thermal inkjet printhead design have also resulted in the production of orifice plates which are produced from a variety of different organic polymers (e.g. plastics) including but not limited to film products consisting of polytetrafluoroethylene (e.g. Teflon®), polyimide, polymethylmethacrylate, polycarbonate, polyester, polyamide, polyethylene-terephthalate, and mixtures thereof. A representative polymeric (e.g. polyimide-based) composition which is suitable for this purpose is a commercial product sold under the trademark "KAPTON" by E. I. du Pont de Nemours & Company of Wilmington, Del. (U.S.A.). Orifice plate structures produced from the non-metallic compositions described above are typically uniform in thickness and highly flexible. Likewise, they provide numerous benefits ranging from reduced production costs to a substantial simplification of the overall printhead structure which translates into improved reliability, economy, and ease of manufacture.

The fabrication of polymeric/plastic film-type orifice plates and the corresponding production of the entire printhead structure is typically accomplished using conventional tape automated bonding ("TAB") technology as generally discussed in U.S. Pat. No. 4,944,850 to Dion. Additional information regarding polymeric, non-metallic orifice plates of the type described above is provided in the following U.S. Pat. Nos. 5,278,584 to Keefe et al. and 5,305,015 to Schantz et al. (incorporated herein by reference). Also of interest is co-pending, co-owned U.S. patent application Ser. No. 08/921,678 (filed on Aug. 28, 1997) entitled "IMPROVED PRINTHEAD STRUCTURE AND METHOD FOR PRODUCING THE SAME" (Meyer et al.) which is likewise incorporated herein by reference. In this document, a number of approaches are outlined for improving the overall durability of polymeric film-type orifice plates. For example, in one embodiment, a protective coating is applied to the top surface and/or the bottom surface of the orifice plate. Representative coatings include diamond-like carbon (which is also known as "DLC"), at least one layer of metal (e.g. chromium [Cr], nickel [Ni], palladium [Pd], gold [Au], titanium [Ti], tantalum [Ta], aluminum [Al], and mixtures thereof), and/or a selected dielectric material (e.g. silicon nitride, silicon dioxide, boron nitride, silicon carbide, and silicon carbon oxide.) This approach is designed to improve the overall abrasion and deformation resistance of the thin-film orifice plate structure and avoids "dimpling" problems associated with these components. Furthermore, the overall durability of the completed structures is particularly enhanced through the use of DLC and the other compositions recited above.

However, other important factors must also be considered in order to produce a printhead using a non-metallic orifice plate which is capable of generating clear, distinct, and vivid printed images over prolonged time periods. For example, a condition known as "ruffling" or "ruffles" can occur in printheads using thin-film polymeric (e.g. plastic) orifice plates of the type discussed herein. This condition can cause a significant deterioration in print quality if not controlled. Thermal inkjet printers of conventional design typically employ at least one wiper element (normally produced from an elastomeric rubber, plastic, or other comparable material) in order to keep the external surface of the orifice plate clean and free from residual ink and other extraneous matter including paper fibers and the like. A representative wiper system used for this purpose is described in U.S. Pat. No. 5,786,830 to Su et al. which is incorporated herein by reference. Printheads which employ thin-film organic polymer-based orifice plates are often adversely affected by the wiping process. Specifically, passage of the wiper element(s) over this type of orifice plate can cause an "uplifting" of the plate structure along the edges of the orifices, thereby creating a "ruffled" appearance with "ridge"-like structures being formed at the peripheral edges of each orifice. This physical deformation of the orifice plate (and the resulting alteration in orifice geometry/planarity) can cause significant changes in ink drop trajectory, namely, the intended pathway to be followed by the ink drop in order to create the final printed image. These undesired changes in orifice plate geometry prevent the ink drop from travelling in its intended direction. Instead, the drop is expelled improperly and is delivered to an undesired location on the print media material (e.g. paper and/or other substrates). Deformation of the orifice plate as outlined above (including the creation of extraneous "ridge" structures around the peripheral edges of the orifices) can also cause the collection or "puddling" of ink in these regions. This situation can further alter ink drop trajectory by causing an undesired interaction between the ink drop being expelled (particularly the terminal portion of each drop or its "tail") with collected ink adjacent the orifices. As a result, print quality degradation occurs over time. These problems are again caused by two primary factors, namely, (1) the thin, flexible nature of the organic polymer orifice plates described herein; and (2) the physical forces imposed on the orifice plates by conventional wiper structures (or other objects which may come in contact with the plates).

In summary, numerous adverse conditions are associated with "ruffling" in a thin-film organic polymer-based orifice plate system ranging from a notable deterioration in print quality to a reduced level of printhead longevity and increased maintenance requirements. Prior to completion of the present invention, a need therefore existed for a polymeric (e.g. plastic) orifice plate system which is highly resistant to the effects of repeated wiping using one or more ink wiper elements and does not experience the ink trajectory problems caused by "ruffling" as previously discussed. The present invention is designed to accomplish these goals in a highly effective and economical manner. In particular, the novel orifice plate and printhead designs described herein (which will be outlined in considerable depth below in the Detailed Description of Preferred Embodiments section) provide the following important benefits: (1) a substantial increase in printhead/orifice plate longevity; (2) the ability to maintain precise control over ink drop trajectory during the life of the printhead; (3) compatibility of the claimed orifice plate with printing units which employ a variety of different wiper systems that are used to clean the printhead; (4) the avoidance of premature damage to the orifice plate notwithstanding its thin-film polymeric character; and (5) the accomplishment of these goals using a technique which avoids the deposition of additional material layers and/or chemical compositions onto the orifice plate which can increase the cost, complexity, and overall labor requirements associated with the printhead fabrication process. The present invention therefore represents a considerable advance in the art of printhead design and image generation technology.

Further information regarding the claimed orifice plate and printhead structures (including specific data involving the technical aspects of the invention along with preferred operating parameters and representative construction materials) will be provided in the following Summary of the Invention and Detailed Description of Preferred Embodiments sections. Likewise, the particular manner in which the claimed invention provides all of the above-described benefits will become readily apparent from the detailed information presented in these sections.

SUMMARY OF THE INVENTION

It is an object of the present invention to provide an improved printhead for use in an ink delivery system which is characterized by high operating efficiency levels.

It is another object of the invention to provide an improved printhead having a greater overall longevity compared with conventional systems.

It is another object of the invention to provide an improved printhead which employs a polymeric (e.g. plastic) orifice plate which is thin and flexible, yet durable and resistant to deformation during the application of physical force thereto.

It is another object of the invention to provide an improved printhead which employs the novel orifice plate described above wherein the orifice plate is especially resistant to the effects of repeated wiping by ink wiper elements that are normally used for cleaning purposes.

It is another object of the invention to provide an improved printhead which employs the novel orifice plate described above wherein the orifice plate avoids "ruffling" problems. As previously stated, "ruffling" involves a disruption or "uplifting" of the orifice plate around the peripheral edges of the orifices caused by physical engagement of the plate with the wiper units mentioned above (or other structures which engage the printhead during use). This problem typically causes undesired changes in ink drop trajectory which leads to a deterioration in print quality.

It is a further object of the invention to provide an improved printhead which employs the novel orifice plate described above that is generally characterized by improved operating efficiency, reduced maintenance problems, minimal system down-time, and uniform print quality levels over time.

It is a further object of the invention to provide an improved printhead which employs the novel orifice plate described above that can be used with a wide variety of ink ejector systems (including but not limited to those which employ thermal inkjet technology).

It is a further object of the invention to provide an improved printhead which employs the novel orifice plate described above that may be used in many different printer units including (1) "on-board", self-contained ink cartridges having an internal ink supply associated therewith; (2) "off-axis" systems in which the printhead (and associated structures) are in operative connection/fluid communication with a remotely-located ink supply.

It is a still further object of the invention to provide an improved printhead which employs the novel orifice plate described above wherein the foregoing benefits are achieved in a highly economical manner which is especially well-suited to mass-production manufacturing processes.

It is an even further object of the invention to provide an improved printhead that employs the novel orifice plate described above in which the foregoing benefits are achieved without the application of additional material layers or chemicals to the orifice plate.

A novel and highly efficient printhead structure is described below which provides numerous advantages over prior systems. As previously stated, the claimed printhead employs a specialized orifice plate of improved durability which avoids problems associated with the passage of wiper units (or other structures) along the plate surface. The orifice plate is made from an organic polymer composition that is specially-designed for this purpose. Prior systems which used thin-film orifice plates of organic polymer origin were subject to a condition known as "ruffles" or "ruffling" which occurred during physical contact between the orifice plate surface and various objects including ink wiper units and the like. This condition resulted in deformation of the orifice plate around the peripheral edges of the orifices (and/or adjacent regions), leading to the creation of "wave-like" ripples or "ridges". In many cases, these deformities also caused undesired ink collection or "puddling" around the orifices. As a result, ink drop trajectory (defined above) was adversely affected, thereby causing a deterioration in print quality over time.

The present invention is designed to avoid the problems listed above while allowing thin-film polymeric orifice plate structures to be employed in a highly effective manner. Furthermore, the benefits outlined herein (including improved print quality over the life of the printhead) are achieved without the application of additional material layers to the orifice plate and/or chemical treatment thereof.

As a preliminary point of information, the present invention shall not be restricted to any particular types, sizes, or arrangements of internal printhead components unless otherwise stated herein. Likewise, the numerical parameters listed in this section and the other sections below constitute preferred embodiments designed to provide optimum results and shall not limit the invention in any respect. The claimed invention and its novel developments are applicable to all types of printing systems without limitation provided that they include (1) at least one substrate as discussed below; (2) at least one ink-ejector positioned on the substrate which, when activated, causes ink materials to be expelled on-demand from the printhead; and (3) an orifice plate having one or more ink ejection openings or "orifices" therethrough that is positioned above the substrate having the ink ejector(s) thereon. The claimed invention shall not be considered "ink ejector-specific" and is not limited to any particular applications, uses, and ink compositions. Likewise, the term "ink ejector" shall be construed to cover one ejector element or groups of multiple ink ejectors regardless of shape, form, or configuration. Specific examples of various ink ejectors which may be used in connection with the invention will be listed below in the Detailed Description of Preferred Embodiments section. However, it is important to note that the present invention is especially suitable for use with ink delivery systems that employ thermal inkjet technology. In thermal inkjet printing units, at least one or more individual thin-film resistor elements are used as ink ejectors to selectively heat ink materials and expel them on-demand from the printhead. Accordingly, the novel orifice plate structures discussed below will be described in connection with thermal inkjet technology with the understanding that the invention shall not be limited to this type of system. The claimed technology is instead prospectively applicable to a wide variety of different printing devices provided that they again employ the basic structures recited above which include a substrate, at least one ink ejector on the substrate, and an orifice plate positioned above the substrate/ink ejector(s).

It should also be understood that the claimed invention shall not be restricted to any particular construction techniques (including any specific material deposition procedures or bore-forming methods) unless otherwise stated in the Detailed Description of Preferred Embodiments. For example, the terms "forming", "applying", "delivering", "placing", and the like as used throughout this discussion to describe the assembly of the claimed printhead and orifice plate shall broadly encompass any appropriate manufacturing procedures. These processes range from thin-film fabrication techniques to laser ablation methods and physical milling processes. In this regard, the invention shall not be considered "production method specific" unless otherwise stated herein.

As previously noted, a highly effective and durable printhead is provided for use in an ink delivery system. The term "ink delivery system" shall, without limitation, involve a wide variety of different devices including cartridge units of the "self-contained" type having a supply of ink stored therein. Also encompassed within this term are printing units of the "off-axis" variety which employ a printhead connected by one or more conduit members to a remotely-positioned ink containment unit in the form of a tank, vessel, housing, or other equivalent structure. Regardless of which ink delivery system is employed in connection with the claimed printhead and orifice plate, the present invention is capable of providing the benefits listed above which include more efficient operation which facilitates the maintenance of high print quality levels over prolonged time periods.

The present invention as described in this section involves a special orifice plate structure produced from an organic polymer composition. The term "organic polymer" shall be defined and used herein in a conventional manner. Organic polymers traditionally involve carbon-containing structures of repeating chemical subunits. Likewise, the terms "organic polymer" and "polymer" shall be generally used in a non-limiting fashion to signify a structure which is optimally produced from one or more plastic-type compounds, examples of which will be provided below. However, the present invention shall not be restricted to any particular plastic/polymeric compounds associated with the claimed orifice plate (or orifice plate sizes, shapes, and configurations) provided that the completed orifice plate structures are able to deliver ink materials in an accurate and consistent manner.

The following discussion shall constitute a brief and general overview of the invention. More specific information involving particular embodiments, best modes, and other important features of the invention will again be recited in the Detailed Description of Preferred Embodiments section set forth below. All scientific terms used throughout this discussion shall be construed in accordance with the traditional meanings attributed thereto by individuals skilled in the art to which this invention pertains unless a special definition is provided herein.

The claimed invention involves a highly-specialized printhead which employs a novel orifice plate structure. The orifice plate (which is produced from at least one organic polymer composition) is highly durable and resistant to the effects of physical contact with a number of objects including but not limited to the wiper units that are normally encountered in conventional printing systems. As a result, the orifice plate and resulting printhead are characterized by improved reliability levels and the avoidance of "ruffling" or other deformation problems. These goals are accomplished by providing an "inset" orifice plate design in which the "main" ink ejection opening associated with each orifice through the plate is located beneath the top surface of the plate so that the wipers (or other physical structures) that may come in contact with the orifice plate do not directly engage this opening. The opening is therefore protected from the effects of physical abrasion and is able to maintain its overall geometric and structural integrity. This design also avoids the formation of excess ink "puddles" at the top surface of the orifice plate around the orifices so that proper ink drop trajectory is maintained. As discussed below, this "inset" configuration is achieved by providing a special "recess" (e.g. an indentation/indented region) above each ink transfer bore through the plate (further described below). Each recess begins at the top surface of the orifice plate and extends inwardly into the interior of the plate.

More detailed information will now be provided regarding the particular structures discussed above, with the understanding that specific information regarding the orifice plate, construction materials, dimensions, and other operational parameters will again be provided in the Detailed Description of Preferred Embodiments sections. In this regard, the present summary is designed to convey a general overview of the invention and shall not limit the invention in any respect.

In accordance with the present invention, a printhead for use in an ink delivery system is provided. As previously noted, the printhead generally includes a substrate having at least one ink ejector thereon (either directly on the substrate surface or supported by the substrate with one or more intermediate material layers therebetween, with both of these alternatives being considered equivalent and encompassed within the language of the present claims). Many different ink ejectors may be employed for this purpose without restriction although the thin-film resistor elements that are typically used in thermal inkjet printing systems are preferred. While the claimed invention shall again be described herein with primary reference to thermal inkjet technology for the sake of clarity and convenience, it shall not be limited in this respect. Next, a novel orifice plate member (or, more simply, an "orifice plate") is provided which is produced from at least one organic polymer (e.g. plastic) composition. This orifice plate is of the general type described above and specifically disclosed in U.S. Pat. Nos. 5,278,584 to Keefe et al. and 5,305,015 to Schantz et al, as well as in co-pending, co-owned U.S. patent application Ser. No. 08/921,678 (filed on Aug. 28, 1997) entitled "IMPROVED PRINTHEAD STRUCTURE AND METHOD FOR PRODUCING THE SAME" (Meyer et al.) all of which are incorporated herein by reference.

The orifice plate (which is securely positioned over and above the substrate comprising the ink ejector thereon) includes a top surface and a bottom surface. The term "top surface" as used and claimed herein shall be defined to involve the particular surface associated with the orifice plate that is outermost relative to the printhead and, in effect, constitutes the "exterior" surface of the orifice plate/printhead that is exposed to the external (outside) environment. It is the last "surface" that the ink will pass through on its journey to the selected print media material. Likewise, it is the surface that is "wiped" using one or more wiping members that are employed in conventional printing units as disclosed, for example, in U.S. Pat. No. 5,786,830 to Su et al. which is likewise incorporated herein by reference.

In contrast, the bottom surface of the orifice plate is the specific surface which is positioned within (e.g. inside) the printhead and is the initial surface of the orifice plate through which the ink enters as it is being expelled. The bottom surface is the innermost (e.g. "unexposed") surface of the orifice plate which, in effect, is located between the top surface of the orifice plate and the substrate having the ink ejector(s) thereon. Finally, it is the specific surface of the orifice plate which is, in fact, adhered to the underlying printhead components including the ink barrier layer as discussed further below. Having presented these specific definitions of the top and bottom surfaces of the orifice plate which define the orientation of the plate relative to the remainder of the printhead, the novel features of the orifice plate will now be discussed.

In a preferred embodiment, at least one "recess" (or indented region/indentation) is provided in the orifice plate which begins at the top surface thereof and terminates at a position within the orifice plate between the top and bottom surfaces inside the main plate structure. The recess includes an upper end, a lower end, and a side wall therebetween which defines the internal boundaries of the recess. The cross-sectional configuration of the recess (discussed in detail below), may involve many different configurations without limitation including but not limited to those which are square, triangular, oval-shaped, and circular (preferred). The upper end of the recess at the top surface of the orifice plate has a first opening therein, with the lower end of the recess comprising a second opening therein. The first opening is larger in size than the second opening, with the second opening being "inset" in accordance with the design described above. The inset location of the second opening (which actually functions as the "main opening" through which ink passes during image generation) provides the benefits listed above. Because of its inset and "protected" location, it is not subject to physical damage and "ruffling" caused by physical abrasion and external forces.

Another important characteristic of the recess in a preferred embodiment is a structural relationship in which the side wall described above is oriented at an angle of about 90° (approximately a right angle) relative to the top surface of the orifice plate member. This design provides a high degree of structural integrity and enables any physical forces applied to the top surface (first opening) of the orifice plate to be effectively confined to this region without being substantially transmitted downward into the recess and second opening. As a result, the overall integrity and planar geometry of the second opening (and surrounding structures) is maintained so that proper ink drop trajectory can occur during the life of the printhead. Likewise, the recess is either partially or (preferably) in complete axial alignment with the ink transfer bore thereunder (and vice versa), with the ink transfer bore being described in greater detail below. Specifically, the longitudinal axes associated with both the recess and bore are in alignment with each other and are coterminous as shown in the drawing figures described in the next section.

At this point, further explanatory information is warranted regarding the relationship between the first opening and the second opening wherein the first opening is "larger in size" than the second opening. The term "larger in size" basically involves a situation in which the cross-sectional area of the first opening exceeds the cross-sectional area of the second opening, with the term "area" being defined conventionally in accordance with the shape of opening under consideration. For example, in situations involving a square or rectangular opening, the cross-sectional area will involve the length of the opening multiplied by its width. Regarding first and/or second openings that are circular, the cross-sectional area thereof will be defined conventionally to involve the formula "$\pi r^2$" wherein r=the radius of the circular opening. Likewise, the conventional formulae that are used to calculate the area of other shapes (ovals, triangles, etc.) may be employed to determine the size of the first and/or second openings.

In situations involving circular first and second openings (which are preferred for numerous reasons including ease of production, the absence of angled surfaces, and the like), the term "larger in size" may also involve a comparison of the respective diameter values of the openings. In an optimum embodiment designed to provide effective results, the first opening and the second opening as previously defined are both circular in cross-section, with the first opening having a first diameter and the second opening having a second diameter. In this particular embodiment, the first diameter of the first opening is preferably at least about 40 $\mu$m or more longer (e.g. larger/greater) than the second diameter of the second opening. However, the present invention shall not be restricted to this numerical range or any other numerical parameters unless otherwise stated herein.

In accordance with the present invention, the first opening should be larger than the second opening for a number of reasons. By providing a first opening at the top surface of the orifice plate which is larger in size than the second opening, the transmission of disruptive physical forces from the top surface (namely, the first opening) to the second opening within the recess is again minimized in accordance with the structural relationship outlined above. While the exact physical mechanism by which this benefit is achieved is not entirely understood, it represents a novel and important feature of the invention. Likewise, the size relationship described above in which the first opening is larger in size than the second opening further facilitates proper ink drop trajectory. Any deformations in the peripheral edges of the first opening at the top surface of the orifice plate which are caused by wiping or other physical abrasion will not adversely affect the ink drop leaving the second opening in the recess in view of the larger size of the first opening relative to (1) the second opening; and (2) the ink drop passing therethrough (with ink drop size being substantially dictated by the size of the second opening within the recess). Because the ink drop is smaller in size than the first opening at the top surface of the orifice plate, the drop will not substantially engage any of the edges associated with the first opening and will therefore not be affected by any deformities (e.g. "ruffles") at the peripheral edges thereof.

Furthermore, the present invention shall not be restricted to any particular sizes or shapes associated with the recess, the first opening, and the second opening. While all of these structures within a given orifice are preferably uniform in cross-sectional shape (e.g. circular, square, etc. from the first end to the second end), it is also contemplated that the recess and its various components could have different cross-sectional shapes at various locations. For example, the first opening at the first end of the recess could be substantially circular in cross-section while the second opening at the second end could be square in cross-section although a uniform design is again preferred and will be emphasized in the remainder of this discussion.

To achieve optimum results in a representative and non-limiting embodiment of the claimed orifice plate, the claimed recess will further comprise a bottom wall at the second end of the recess. The second opening described above passes through the bottom wall. The bottom wall is preferably planar in configuration and substantially parallel with the top surface of the orifice plate. Likewise, the bottom wall is preferably oriented at an angle of about 90° (approximately a right angle) relative to the side wall of the recess. As noted above, the side wall of the recess is optimally oriented at an angle of about 90° (approximately a right angle) relative to the top surface of the orifice plate member. In this configuration where both of the right angle relationships described above are employed in combination, the recess will be substantially cylindrical or disk-shaped as shown in the accompanying drawing figures. This design provides an especially high degree of structural integrity, deformation resistance, and the ability to maintain proper ink drop trajectory over time.

However, the claimed recess shall not be limited to the angular relationships provided above which constitute representative embodiments provided for example purposes. In situations involving the use of a recess having a bottom wall as previously described, many other variations are possible within the scope of the invention provided that the claimed recess having the desired functional capabilities is produced. For example, as clearly shown in the accompanying drawing figures and outlined in the Detailed Description of Preferred Embodiments presented below, a number of different angular relationships are contemplated involving the side wall, bottom wall, and top surface of the orifice plate relative to each other. For example, as illustrated in the accompanying drawing figures, the side wall associated with the recess may actually be oriented at an angle which exceeds about 90° relative to the top surface of the orifice plate. Specifically, the angular relationship between the side wall of the recess and the top surface of the orifice plate may involve: (1) an angle of about 90° (approximately a right angle); or (2) an "obtuse" angle, namely, an angle which exceeds 90° (but is less than 180°), with a preferred, non-limiting upper limit being about 145°. Likewise, the bottom wall at the second end of the recess (through which the second opening passes) can be oriented at an angle of about 45–165° relative to the side wall of the recess. While the dual 90° angle relationship between (A) the side wall and the top surface of the orifice plate; and (B) the bottom wall of the recess and the side wall which produces a cylindrical or disk-shaped recess is again preferred, the various angular values listed above (or others) can also be employed in multiple combinations without limitation. The selection of any given dimensions, angles, and the like in the present invention shall be determined in accordance with routine preliminary pilot testing taking into account numerous diverse factors ranging from the types of construction materials associated with the orifice plates to the manner in which the claimed printheads will be used.

Having described the novel recess provided in the claimed orifice plate (which offers numerous benefits including but not limited to the creation of an "inset" ink expulsion opening which is resistant to deformation caused by physical abrasion, wiping, and the like), the remaining portions of the orifice which reside beneath the recess will now be discussed. Positioned below the recess and in fluid communication therewith is an ink transfer bore. The ink transfer bore is in partial or (preferably) complete axial alignment with the recess and vice versa as previously discussed. As a result, ink materials expelled by the ink ejector(s) will pass upwardly through the bore, through the recess at the top surface of the orifice plate, and out of the printhead for delivery to a selected print media material (made of paper, metal, plastic, and the like). To accomplish this goal and from a functional standpoint, the ink transfer bore begins at the second end of the recess (e.g. at the second opening therein) and terminates at the bottom surface of the orifice plate member. The ink transfer bore is the first structure within the orifice plate to actually receive ink materials during the expulsion process, with the ink then passing through the bore and recess for ultimate delivery as previously noted. While a number of different structural designs may be employed in connection with the ink transfer bore as outlined below in the Detailed Description of Preferred Embodiments section, the bore is optimally uniform in cross-section along its entire length. Likewise, the bore includes a side wall therein which is preferably oriented at an "acute" (less than 90°) angle relative to the top surface of the orifice plate member in order to form a substantially "cone-shaped" structure. This design promotes rapid and complete ink entry into and through the orifice plate. However, other side wall designs may be employed in connection with the ink transfer bore including but not limited to those which form an angle of about 90° (approximately a right angle) or more relative to the top surface of the orifice plate member. The selection of any given internal design relative to the claimed ink transfer bore may again be determined using routine preliminary pilot testing.

Additional data involving printhead assembly techniques and other related information will be set forth below (including a variety of construction methods which may be used to fabricate the various structural features of the orifice plate). For example, representative construction methods that can be employed to produce the claimed recess and ink transfer bore range from laser ablation methods to chemical etching and physical processing techniques in which drilling devices are used. Accordingly, a number of conventional procedures can be employed without limitation for the purposes described above. It should also be emphasized that many different printhead components, ink ejectors, size parameters, and the like are applicable to the present invention provided that the novel orifice plate is used as part of the basic printhead structure. This orifice plate again provides improved durability and proper ink drop trajectory control. In addition to the novel orifice plate recited herein, an improved "ink delivery system" is likewise provided in which an ink containment vessel is operatively connected to and in fluid communication with the claimed printhead discussed above. As extensively reviewed in the Detailed Description of Preferred Embodiments section, the term "operatively connected" relative to the printhead and ink containment vessel shall involve a number of different situations including but not limited to the use of (1) cartridge units of the "self-contained" type in which the ink containment vessel is directly attached to the printhead to produce a system having an "on-board" ink supply; and (2) printing units of the "off-axis" variety which employ a printhead connected by one or more conduit members (or similar structures) to a remotely-positioned ink containment unit in the form of a tank, vessel, housing, or other equivalent structure. The novel printheads and orifice plates of the present invention shall not be restricted to use with any particular ink containment vessels, the proximity of these vessels to the printheads, and the means by which the vessels and printheads are attached to each other.

Finally, the invention shall also encompass a method for producing the claimed high-efficiency printheads. The fabrication steps which are used for this purpose involve the materials and components listed above, with the previously-described summary of these items being incorporated by reference in this discussion. The basic production steps are as follows: (1) providing an orifice plate having the features listed above (and incorporated by reference herein); (2) providing a substrate comprising at least one ink ejector thereon as previously noted; and (3) securing the orifice plate member fixedly in position over and above the substrate in order to produce the printhead. In a preferred embodiment, the orifice plate will have a recess with a side wall therein that is oriented at an angle of about 90° (approximately a right angle) relative to the top surface of the plate and/or a bottom wall at the second end of the recess which is substantially parallel to the top surface. Other variations are possible as noted above, with the claimed orifice plate not being restricted to the specific features recited in this section. It should likewise be noted that fabrication of the recess within the top surface of the orifice plate may be undertaken before or after attachment of the orifice plate in position on the underlying portions of the printhead, with both techniques being considered equivalent. Accordingly, any statements presented herein which indicate that an orifice plate having the claimed features (including the recess) is "provided" will encompass by equivalence both of the alternatives listed above.

The present invention represents a significant advance in the art of thermal inkjet technology and the generation of high-quality images with improved reliability, speed, and longevity. The novel structures, components, and methods described herein offer many important benefits including but not limited to (1) a substantial increase in printhead/orifice plate longevity; (2) the ability to maintain precise control over ink drop trajectory during the life of the printhead; (3) compatibility of the claimed orifice plate with printing units which employ a variety of different wiper systems that are used to clean the printhead; (4) the avoidance of premature damage to the orifice plate notwithstanding its thin-film polymeric character; (5) the ability to provide a high-durability thin-film polymeric orifice plate structure which can maintain its light and thin profile while preventing the problems discussed above; and (6) the accomplishment of these goals using a technique which avoids the deposition of additional material layers and/or chemical compositions onto the orifice plate which can increase the cost, complexity, and overall labor requirements associated with the printhead fabrication process. These and other benefits, objects, features, and advantages of the invention will now be discussed in the following Brief Description of the Drawings and Detailed Description of Preferred Embodiments.

BRIEF DESCRIPTION OF THE DRAWINGS

The drawing figures provided below are schematic and representative only. They shall not limit the scope of the invention in any respect. Likewise, reference numbers which are carried over from one figure to another shall constitute common subject matter in the figures under consideration.

DETAILED DESCRIPTION OF PREFERRED EMBODIMENTS

Figure 1:
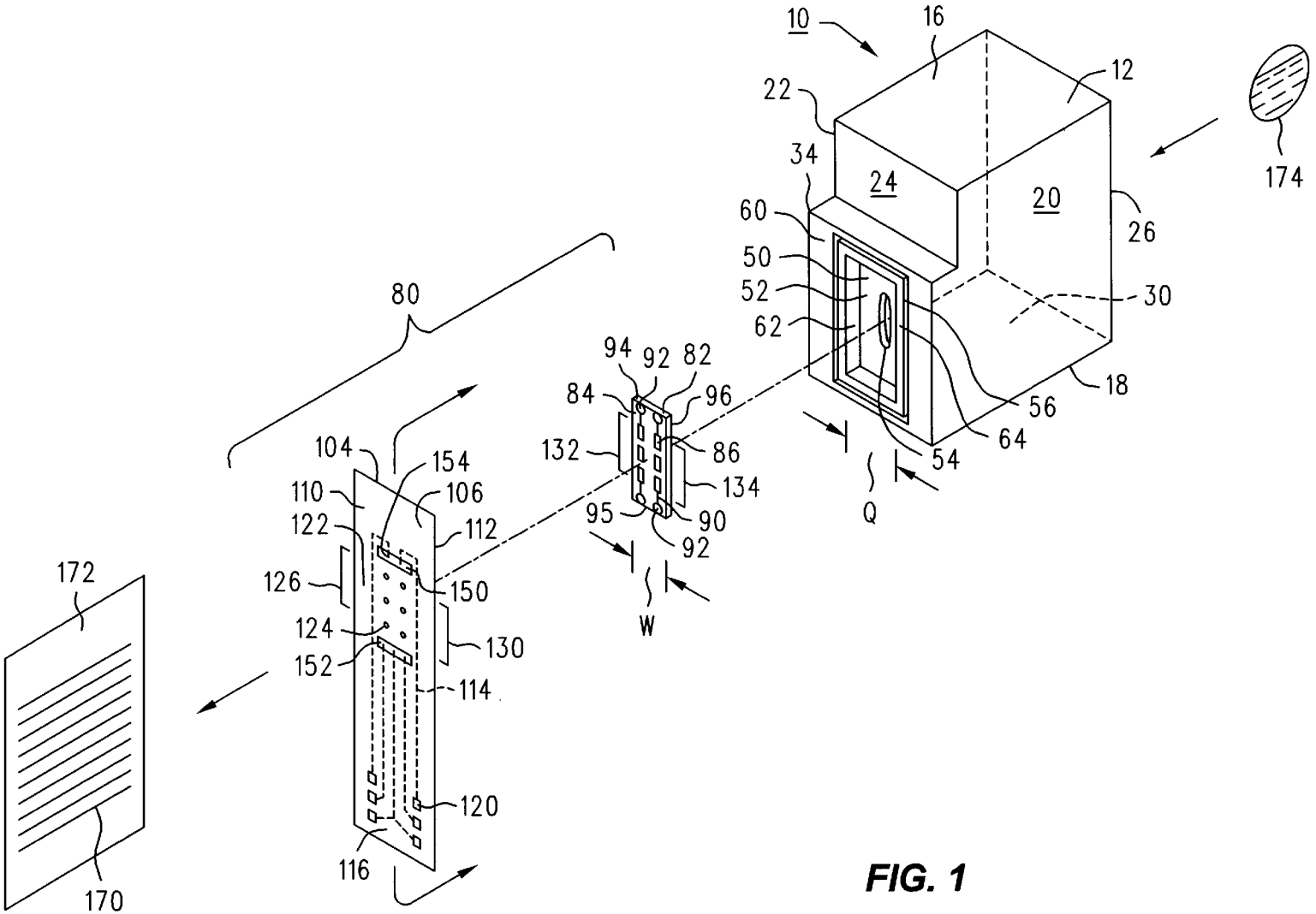
FIG. 1 is a schematically-illustrated, exploded perspective view of a representative ink delivery system in the form of an ink cartridge which is suitable for use with the components and methods of the present invention. The ink cartridge of FIG. 1 has an ink containment vessel directly attached to the printhead of the claimed invention so that an "on-board" ink supply is provided.

The present invention involves a unique printhead for an ink delivery system which includes a specialized orifice plate through which the ink passes. The ink is then delivered to a selected print media material (paper, metal, plastic, and the like) using conventional printing techniques. Thermal inkjet printing systems are especially suitable for this purpose. They employ at least one or more thin-film resistor elements on a substrate which selectively heat and expel ink on-demand. The claimed invention will be described in this section with primary reference to thermal inkjet technology. However, it shall be understood that the invention is also applicable to other ink delivery systems provided that they include a substrate, at least one ink ejector on the substrate, and an orifice plate positioned above the substrate/ink ejector. Other representative ink ejectors will be listed below for reference purposes.

The claimed printheads include an orifice plate with multiple openings therethrough. The orifice plate is produced from a non-metallic, organic polymer (e.g. plastic) film with specific examples also being presented below. To improve the durability of this structure, the orifice plate includes a novel orifice design which avoids a problem known as "ruffles" or "ruffling". This condition occurs when the orifice plate surface (namely, the top surface as defined herein) comes in contact with an object that "rubs" or otherwise travels across the surface in a physically engaging manner. For example, "ruffling" can take place when a thin-film polymeric orifice plate is "wiped" by an elastomeric wiper element of the type shown in U.S. Pat. No. 5,786,830 to Su et al.

As discussed in greater detail below, "ruffling" of the orifice plate causes uplifted "ridge"-like structures to form along the peripheral edges of the orifices. This physical deformation of the orifice plate (and the resulting alteration in orifice geometry/planarity) can cause significant changes in ink drop trajectory, namely, the intended pathway to be followed by the ink drop in order to create the final printed image. These undesired changes in orifice plate geometry prevent the ink drop from travelling in its intended direction. Instead, the drop is expelled improperly and is delivered to an undesired location on the print media material. Deformation of the orifice plate as outlined above (including the creation of extraneous "ridge" structures around the peripheral edges of the orifices) can also cause the collection or "puddling" of ink in these regions. This situation can further alter ink drop trajectory by causing an undesired interaction between the ink drop being expelled (particularly the terminal portion of each drop or its "tail") with collected ink adjacent the orifices. As a result, print quality deterioration occurs over time. These problems are again caused by two primary factors, namely, (1) the thin, flexible nature of the organic polymer orifice plates described herein; and (2) the physical forces imposed on the orifice plates by conventional wiper structures (or other objects which may come in contact therewith).

To solve these problems, a novel orifice design is employed in the claimed orifice plate. Specifically, the "main opening" (defined below) leading into the orifice is "inset" by providing this opening within a "recess". The recess begins at the top surface of the plate and terminates at a location within the plate between the top and bottom surfaces. By "isolating" this opening as indicated above, it is "protected" from damage caused by the passage of ink wipers and other structures over the top surface of the orifice plate. In this manner, "ruffling"-based ink trajectory problems are avoided. The claimed invention therefore represents a significant advance in printing technology, with the benefits and specific details thereof being outlined below.

As previously noted, the present invention shall be described herein with primary reference to thermal inkjet technology. The term "thermal inkjet printhead" as used throughout this discussion shall be broadly construed to encompass, without restriction, any type of printhead having at least one heating resistor therein which is used to thermally excite ink materials for delivery to a print media material. In this regard, the invention shall not be limited to any particular thermal inkjet printhead designs, with many different structures and internal component arrangements being possible provided that they include the resistor elements mentioned above which expel ink on-demand using thermal processes. Likewise, the invention shall not be restricted to any particular printhead structures, technologies, or ink ejector types unless otherwise stated herein and is prospectively applicable to many thermal inkjet systems, as well as systems which employ other technologies that do not use thermal inkjet devices.

The claimed printheads and orifice plates are also applicable to many different ink delivery systems as previously stated including (1) on-board cartridge-type units having a self-contained supply of ink therein which is operatively connected to and in fluid communication with the printhead; and (2) "off-axis" units which employ a remotely-positioned ink containment vessel that is operatively connected to and in fluid communication with the printhead using one or more fluid transfer conduits. The printhead described below shall therefore not be considered "system specific" relative to the ink storage devices associated therewith. To provide a clear and complete understanding of the invention, the following detailed description will be divided into three sections, namely, (1) "A. A General Overview of Printhead Technology"; (2) "B. The Novel Orifice Plate Structures of the Present Invention"; and (3) "C. Ink Delivery Systems using the Novel Printheads/Orifice Plates and Fabrication Methods Associated Therewith".

A. A General Overview of Printhead Technology

As noted above, the present invention is applicable to a wide variety of ink cartridge printheads which include (1) an orifice plate member having one or more openings therethrough; and (2) a substrate beneath the orifice plate member comprising at least one or more ink "ejectors" thereon or associated therewith. The term "ink ejector" shall be defined to encompass any type of component or system which selectively ejects or expels ink materials from the printhead through the plate member. Thermal inkjet printing systems which use multiple heating resistors as ink ejectors are preferred for this purpose. However, the present invention shall not be restricted to any particular type of ink ejector or inkjet printing system as noted above. Instead, a number of different ink delivery devices may be encompassed within the invention including but not limited to piezoelectric drop systems of the general type disclosed in U.S. Pat. No. 4,329,698 to Smith, dot matrix systems of the variety described in U.S. Pat. No. 4,749,291 to Kobayashi et al., as well as other comparable and functionally equivalent systems designed to deliver ink using one or more ink ejectors. The specific ink-expulsion devices associated with these alternative systems (e.g. the piezoelectric elements in the system of U.S. Pat. No. 4,329,698) shall be encompassed within the term "ink ejectors" as discussed above. Accordingly, even though the present invention will be discussed herein with primary reference to thermal inkjet technology, it shall be understood that other systems are equally applicable and relevant to the claimed technology.

To facilitate a complete understanding of the present invention as it applies to thermal inkjet technology (which is the preferred system of primary interest), an overview of this technical field will now be provided. The ink delivery systems schematically shown in the drawing figures listed above (e.g. FIGS. 1–4) are provided for example purposes only and are non-limiting.

With reference to FIG. 1, a representative thermal inkjet ink cartridge 10 is illustrated. This cartridge is of a general type shown and described in U.S. Pat. No. 5,278,584 to Keefe et al. and the *Hewlett-Packard Journal,* Vol. 39, No. 4 (August 1988), both of which are incorporated herein by reference. It is again emphasized that cartridge 10 is shown in schematic format, with more detailed information regarding cartridge 10 being provided in U.S. Pat. No. 5,278,584. As illustrated in FIG. 1, the cartridge 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 additionally includes a front wall 24 and a rear wall 26 which is optimally parallel to the front wall 24. Surrounded by the front wall 24, top wall 16, bottom wall 18, first side wall 20, second side wall 22, and rear wall 26 is an interior chamber or compartment 30 within the housing 12 (shown in phantom lines in FIG. 1) which is designed to retain a supply of ink therein. Many compositions can be used in connection with the ink including but not limited to those recited in U.S. Pat. No. 5,185,034 to Webb et al. which is incorporated herein by reference. The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64 which will likewise be described in greater detail below.

With continued reference to FIG. 1, fixedly secured to housing 12 of the ink cartridge unit 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). These components and additional information concerning the printhead 80 are again outlined in U.S. Pat. No. 5,278,584 to Keefe et al. which discusses the ink cartridge 10 in considerable detail. The first main component used to produce the printhead 80 consists of a substrate 82 preferably manufactured from silicon [Si] or other conventional materials known in the art for this purpose. Secured to and positioned on the upper surface 84 of the substrate 82 using standard thin film fabrication techniques is a plurality of individually energizable thin-film resistors 86 which function as "ink ejectors" and are preferably made from a tantalum-aluminum [TaAl] composition known in the art for resistor fabrication. Only a small number of resistors 86 are shown in the representation of FIG. 1, with the resistors 86 being presented in enlarged schematic format for the sake of clarity. It should likewise be noted that any statements provided herein involving the use of a substrate having at least one ink ejector thereon shall encompass a situation in which (1) the ink ejector is secured directly on and to the surface of the substrate without any intervening material layers therebetween; or (2) the ink ejector is supported by the substrate (e.g. positioned thereon) in which one or more intermediate material layers are located between the substrate and ink ejector, with both of these alternatives being considered equivalent and encompassed within the present claims. For example, conventional thermal inkjet systems may, in fact, employ an electrically insulating base layer made of silicon dioxide [$SiO_2$] on the substrate, with the resistor elements being placed on the base layer. Accordingly, placement of the selected ink ejectors (e.g. resistors 86) on a given substrate shall again be deemed to encompass both of the alternatives outlined above.

Also provided on the upper surface 84 of the substrate 82 using conventional photolithographic/metallization techniques is a plurality of metallic conductive traces 90 which electrically communicate with the resistors 86. The conductive traces 90 also communicate with multiple metallic pad-like contact regions 92 positioned at the ends 94, 95 of the substrate 82 on the upper surface 84. The function of all these components which, in combination, are collectively designated herein as a resistor assembly 96 will be discussed further below. Many different materials and design configurations may be used to construct the resistor assembly 96, with the present invention not being restricted to any particular elements, materials, and components for this purpose. However, in a preferred, representative, and non-limiting embodiment discussed in U.S. Pat. No. 5,278,584 to Keefe et al., the resistor assembly 96 will be approximately 0.5 inches long, and will likewise contain 300 resistors 86 thus enabling a resolution of 600 dots per inch ("DPI"). The substrate 82 containing the resistors 86 thereon will preferably have a width "W" (FIG. 1) which is less than the distance "Q" between the side walls 62, 64 of the mounting frame 56. As a result, ink flow passageways 100, 102 (schematically shown in FIG. 2) are formed on both sides of the substrate 82 so that ink flowing from the ink outlet port 54 in the central cavity 50 can ultimately come in contact with the resistors 86 as discussed further below.

It should also be noted that the substrate 82 may include a number of other components thereon (not shown) depending on the type of ink cartridge 10 under consideration. For example, the substrate 82 may likewise include a plurality of logic transistors for precisely controlling operation of the resistors 86, as well as a "demultiplexer" of conventional configuration as outlined in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contract regions 92 and traces 90) formed on the substrate 82. Other features of the substrate 82 (e.g. the resistor assembly 96) will be presented herein.

Securely affixed in position above the substrate 82 and resistors 86 (with a number of intervening material layers therebetween including an ink barrier layer and an adhesive layer in the conventional design of FIG. 1 as discussed further below) is the second main component of the printhead 80. Specifically, an orifice plate 104 of conventional design (compared with the novel structure of the claimed invention) is provided which is used to distribute the selected ink compositions to a designated print media material (made of paper, metal, plastic, and the like). Prior orifice plate designs involved a rigid plate structure manufactured from an inert metal composition (e.g. gold-plated nickel). However, recent developments in thermal inkjet technology have resulted in the use of non-metallic, organic polymer films to construct the orifice plate 104. As illustrated in FIG. 1, this type of orifice plate 104 will consist of a flexible film-type elongate member 106 manufactured from a selected organic polymer film product which may or may not (preferred) include metal atoms within or attached to the basic polymeric structure. The phrase "organic polymer" shall be defined in a conventional manner. Organic polymers basically involve carbon-containing structures of repeating organic chemical subunits. A number of different polymeric compositions may be employed for this purpose, with the present invention not being restricted to any particular construction materials. For example, the orifice plate 104 may be manufactured from the following compositions: polytetrafluoroethylene (e.g. Teflon®), polyimide, polymethylmethacrylate, polycarbonate, polyester, polyamide, polyethylene-terephthalate, or mixtures thereof. Likewise, a representative commercial organic polymer (e.g. polyimide-based) composition which is suitable for constructing the orifice plate 104/elongate member 106 is a product sold under the trademark "KAPTON" by E. I. du Pont de Nemours & Company of Wilmington, Del. (U.S.A.). Orifice plate structures produced from the non-metallic compositions described above are typically uniform in thickness and highly flexible. Likewise, they provide numerous benefits ranging from reduced production costs to a substantial simplification of the overall printhead architecture which translates into improved reliability, economy, and ease of manufacture. As shown in the schematic illustration of FIG. 1, the flexible orifice plate 104 is designed to "wrap around" the outwardly extending printhead support structure 34 in the completed ink cartridge 10.

Figure 2:
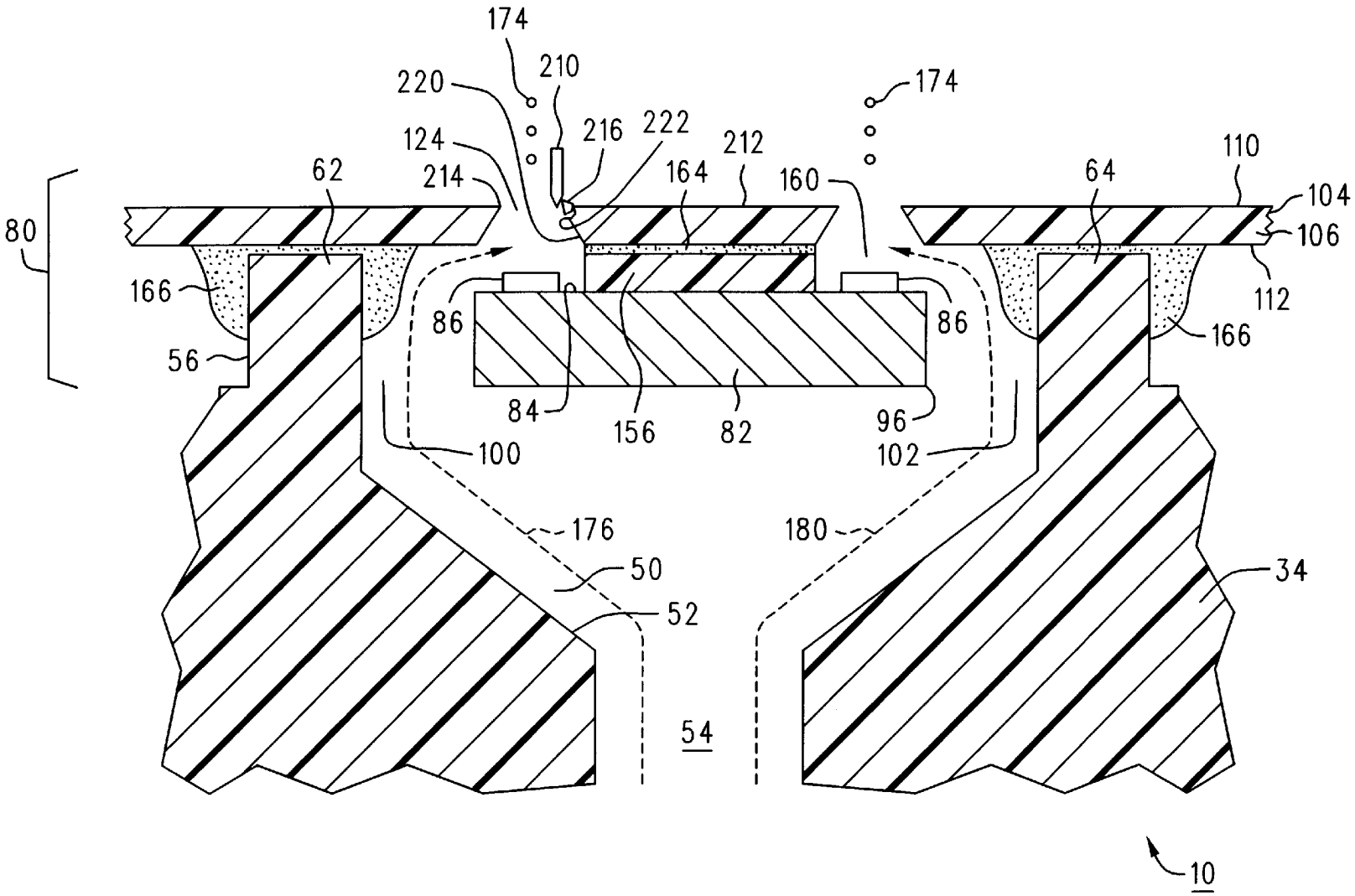
FIG. 2 is a schematically-illustrated, enlarged partial cross-sectional view of the printhead used in the ink cartridge unit of FIG. 1 wherein a conventional orifice plate structure is employed.

The film-type elongate member 106 which is used to form the orifice plate 104 further includes a top surface 110 and a bottom surface 112 (FIGS. 1 and 2). Formed on the bottom surface 112 of the orifice plate 104 and shown in dashed lines in FIG. 1 is a plurality of metallic (e.g. copper) circuit traces 114 which are applied to the bottom surface 112 using known metal deposition and photolithographic techniques. Many different circuit trace patterns may be employed on the bottom surface 112 of the elongate member 106 (orifice plate 104), with the specific pattern depending on the particular type of ink cartridge 10 and printing system under consideration. Also provided at position 116 on the top surface 110 of the orifice plate 104 is a plurality of metallic (e.g. gold-plated copper) contact pads 120. The contact pads 120 communicate with the underlying circuit traces 114 on the bottom surface 112 of the plate 104 via openings or "vias" (not shown) through the elongate member 106. During use of the ink cartridge 10 in a printer unit, the pads 120 come in contact with corresponding printer electrodes in order to transmit electrical control signals from the printer unit to the contact pads 120 and circuit traces 114 on the orifice plate 104 for ultimate delivery to the resistor assembly 96. Electrical communication between the resistor assembly 96 and the orifice plate 104 will be discussed below.

Positioned within the middle region 122 of the elongate member 106 used to produce the orifice plate 104 is a plurality of openings or orifices 124 which pass entirely through the plate 104. These orifices 124 are shown in enlarged format in FIGS. 1–2. In the completed printhead 80, all of the components listed above are assembled (discussed below) so that each of the orifices 124 is aligned with at least one of the resistors 86 (e.g. "ink ejectors") on the substrate 82. As result, energization of a given resistor 86 will cause ink expulsion from the desired orifice 124 through the orifice plate 104. In a representative embodiment as presented in FIG. 1, the orifices 124 are arranged in two rows 126, 130 on the elongate member 106. Likewise, if this arrangement of orifices 124 is employed, the resistors 86 on the resistor assembly 96 (e.g. the substrate 82) will also be arranged in two corresponding rows 132, 134 so that the rows 132, 134 of resistors 86 are in substantial registry (e.g. alignment) with the rows 126, 130 of orifices 124.

Finally, as shown in FIG. 1, dual rectangular windows 150, 152 are provided at each end of the rows 126, 130 of orifices 124. Partially positioned within the windows 150, 152 are beam-type leads 154 which, in a representative embodiment, are gold-plated copper and constitute the terminal ends (e.g. the ends opposite the contact pads 120) of the circuit traces 114 positioned on the bottom surface 112 of the elongate member 106/orifice plate 104. The leads 154 are designed for electrical connection by soldering, thermocompression bonding, and the like to the contact regions 92 on the upper surface 84 of the substrate 82 associated with the resistor assembly 96. Attachment of the leads 154 to the contact regions 92 on the substrate 82 is facilitated during mass production manufacturing processes by the windows 150, 152 which enable immediate access to these components. As a result, electrical communication is established from the contact pads 120 to the resistor assembly 96 via the circuit traces 114 on the orifice plate 104. Electrical signals from the printer unit (not shown) can then travel via the conductive traces 90 on the substrate 82 to the resistors 86 so that on-demand heating (energization) of the resistors 86 can occur.

At this point, it is important to briefly discuss fabrication techniques in connection with the structures described above which are used to manufacture the printhead 80. Regarding the orifice plate 104, all of the openings therethrough including the windows 150, 152 and the orifices 124 are typically formed using conventional laser ablation techniques as again discussed in U.S. Pat. No. 5,278,584 to Keefe et al. Specifically, a mask structure initially produced using standard lithographic techniques is employed for this purpose. A laser system of conventional design is then selected which, in a preferred embodiment, involves an excimer laser of a type selected from the following alternatives: $F_2$, ArF, KrCl, KrF, or XeCl. Using this particular system (along with preferred pulse energies of greater than about 100 millijoules/$cm^2$ and pulse durations shorter than about 1 microsecond), the above-listed openings (e.g. orifices 124) can be formed with a high degree of accuracy, precision, and control. Other methods are also suitable for producing the completed orifice plate 104/orifices 124 including conventional ultraviolet ablation processes (e.g. using ultraviolet light in the range of about 150–400 nm), as well as standard chemical etching, stamping, reactive ion etching, ion beam milling, mechanical drilling, and similar known processes.

After the orifice plate 104 is produced as discussed above, the printhead 80 is completed by attaching the resistor assembly 96 (e.g. the substrate 82 having the resistors 86 thereon) to the orifice plate 104. In a preferred embodiment, fabrication of the printhead 80 is accomplished using tape automated bonding ("TAB") technology. The use of this particular process to produce the printhead 80 is again discussed in considerable detail in U.S. Pat. No. 5,278,584. Likewise, background information concerning TAB technology is also generally provided in U.S. Pat. No. 4,944,850 to Dion. In a TAB-type fabrication system, the processed elongate member 106 (e.g. the completed orifice plate 104) which has already been ablated and patterned with the circuit traces 114 and contact pads 120 actually exists in the form of multiple, interconnected "frames" on an elongate "tape", with each "frame" representing one orifice plate 104. The tape (not shown) is thereafter positioned (after cleaning in a conventional manner to remove impurities and other residual materials) in a TAB bonding apparatus having an optical alignment sub-system. Such an apparatus is well-known in the art and commercially available from many different sources including but not limited to the Shinkawa Corporation of Japan (model no. IL-20 or other comparable model). Within the TAB bonding apparatus, the substrate 82 associated with the resistor assembly 96 and the orifice plate 104 are properly oriented so that (1) the orifices 124 are in precise alignment with the resistors 86 on the substrate 82; and (2) the beam-type leads 154 associated with the circuit traces 114 on the orifice plate 104 are in alignment with and positioned against the contact regions 92 on the substrate 82. The TAB bonding apparatus then uses a "gang-bonding" method (or other similar procedures) to press the leads 154 onto the contact regions 92 (which is accomplished through the open windows 150, 152 in the orifice plate 104). The TAB bonding apparatus thereafter applies heat in accordance with conventional bonding processes in order to secure these components together. It is also important to note that other standard bonding techniques may likewise be used for this purpose including but not limited to ultrasonic bonding, conductive epoxy bonding, solid paste application processes, and similar methods. In this regard, the claimed invention shall not be restricted to any particular processing techniques associated with the printhead 80.

As previously noted in connection with the conventional ink cartridge 10 of FIG. 1, additional layers of material are typically present between the orifice plate 104 and resistor assembly 96 (e.g. substrate 82 with the resistors 86 thereon). These additional layers perform various functions including electrical insulation, adhesion of the orifice plate 104 to the resistor assembly 96, and the like. With reference to FIG. 2, the printhead 80 is schematically illustrated in cross-section after attachment to the housing 12 of the cartridge 10, with attachment of these components being discussed in further detail below. As shown in FIG. 2, the upper surface 84 of the substrate 82 (and the various additional materials positioned on this component as outlined later in this section) likewise includes an intermediate ink barrier layer 156 thereon which covers the conductive traces 90 (FIG. 1), but is positioned between and around the resistors 86 without covering them. As a result, an ink vaporization chamber 160 (FIG. 2) is formed directly above each resistor 86. Within each chamber 160, ink materials are heated, vaporized, and subsequently expelled through the orifices 124 in the orifice plate 104.

The barrier layer 156 (which is traditionally produced from conventional organic polymers, photoresist materials, or similar compositions as outlined in U.S. Pat. No. 5,278,584) is applied to the substrate 82 using standard techniques known in the art for this purpose. Specific materials which can be employed to fabricate the ink barrier layer 156 include but are not limited to (1) dry photoresist films containing half acrylol esters of bis-phenol; (2) epoxy monomers; (3) acrylic and melamine monomers [e.g. those which are sold under the trademark "Vacrel" by E. I. DuPont de Nemours and Company of Wilmington, Del. (U.S.A.)]; and (4) epoxy-acrylate monomers [e.g. those which are sold under the trademark "Parad" by E. I. DuPont de Nemours and Company of Wilmington, Del. (U.S.A.)]. However, the claimed invention shall not be restricted to any particular barrier compositions or methods for applying the ink barrier layer 156 in position. Regarding preferred application methods, the barrier layer 156 is traditionally delivered by high speed centrifugal spin coating devices, spray coating units, roller coating systems, and the like. However, the particular application method for any given situation will depend on the barrier layer 156 under consideration.

In addition to clearly defining the vaporization chambers 160, the barrier layer 156 also functions as a chemical and electrical insulation layer. Positioned on top of the barrier layer as shown in FIG. 2 is an adhesive layer 164 which may involve a number of different compositions. Representative adhesive materials suitable for this purpose include commercially available epoxy resin and cyanoacrylate adhesives known in the art for this purpose. Likewise, the adhesive layer 164 may involve the use of uncured poly-isoprene photoresist compounds as recited in U.S. Pat. No. 5,278,584 as well as (1) polyacrylic acid; and/or (2) a selected silane coupling agent. The term "polyacrylic acid" shall be conventionally defined to involve a compound having the following basic chemical structure $[CH_2CH(COOH)_n]$ wherein n=25–10,000. Polyacrylic acid is commercially available from numerous sources including but not limited to the Dow Chemical Corporation of Midland, Mich. (U.S.A.). Representative silane coupling agents which may be employed in connection with the adhesive layer 164 include but are not limited to commercial products sold by the Dow Chemical Corporation of Midland, Mich. (U.S.A.) [product nos. 6011, 6020, 6030, and 6040], as well as OSI Specialties of Danbury, Conn. (U.S.A.) [product no. "Silquest" A-1100]. However, the above-listed materials are provided for example purposes only and shall not limit the invention in any respect.

The adhesive layer 164 is specifically used to attach/secure the orifice plate 104 to and within the printhead 80 so that the orifice plate 104 is fixedly secured in position over and above the substrate 82 having the resistors 86 thereon.

It is important to note that the use of a separate adhesive layer 164 may, in fact, not be necessary if the top surface of the ink barrier layer 156 can be made adhesive in some manner (e.g. if it consists of a material which, when heated, becomes pliable with adhesive characteristics). However, in accordance with the conventional structures and materials shown in FIGS. 1–2, a separate adhesive layer 164 is employed.

It should likewise be understood that there are typically a number of additional material layers positioned between the barrier layer 156 as illustrated in FIG. 2 and the underlying substrate 82 which are not shown for the sake of clarity and convenience. For information on these structures, U.S. Pat. Nos. 4,535,343 to Wright et al.; 4,616,408 to Lloyd; and 5,122,812 to Hess et al. may be consulted which are incorporated herein by reference. In summary, these materials normally include the following layers (not shown): (1) a dielectric "base layer" (conventionally made from silicon dioxide [$SiO_2$]) located directly on the substrate 82 which is designed to electrically insulate the substrate 82 from the resistors 86; (2) layer of a "resistive material" on the base layer which is used to create or "form" the resistor elements 86 (typically made from a mixture of elemental aluminum [Al] and elemental tantalum [Ta] also known as "TaAl" that is known in the art for thin-film resistor fabrication), with other exemplary resistive materials including phosphorous-doped polycrystalline silicon [Si], tantalum nitride [$Ta_2N$], nichrome [NiCr], hafnium bromide [$HfBr_4$], elemental niobium [Nb], elemental vanadium [V], elemental hafnium [Hf], elemental titanium [Ti], elemental zirconium [Zr], elemental yttrium [Y], and mixtures thereof; (3) a "conductive layer" of material (e.g. elemental aluminum [Al], elemental gold [Au], elemental copper [Cu], and/or elemental silicon [Si]) which is positioned on the resistive layer in discrete portions having gaps therebetween, with the "exposed" sections of the resistive layer between the gaps forming the resistor elements 86; (4) a "first passivation layer" made from, for example, silicon dioxide [$SiO_2$], silicon nitride [SiN], aluminum oxide [$Al_2O_3$], or silicon carbide [SiC] which is positioned over the conductive layer/resistor elements 86 for protective purposes; (5) an optional protective "second passivation layer" made from, for example, silicon carbide [SiC], silicon nitride [SiN], silicon dioxide [$SiO_2$], or aluminum oxide [$Al_2O_3$] positioned on the first passivation layer; (6) an electrically conductive and protective "cavitation layer" made from, for example, elemental tantalum [Ta], elemental molybdenum [Mo], elemental tungsten [W], or mixtures/alloys thereof that is placed on the second passivation layer or first passivation layer depending on whether the second passivation layer is employed; and (7) an optional internal adhesive layer placed on the cavitation layer which may involve a number of different compositions without limitation including conventional epoxy resin materials, standard cyanoacrylate adhesives, silane coupling agents, and the like. This layer (if needed as determined by routine preliminary testing) is used to secure the barrier layer 156 in position on the underlying printhead components.

In accordance with the information provided above, it shall therefore be understood that the structure shown in FIG. 2 is schematic in nature and designed to illustrate only the most basic components associated with the printhead 80. Since the current invention is primarily directed to the novel orifice plate of the present invention as outlined in the next section, the abbreviated illustration of FIG. 2 is provided for clarity and convenience, with reference being made to the patent documents cited above should expanded information be desired.

Referring back to the TAB bonding process as previously discussed, the printhead 80 is ultimately subjected to heat and pressure within a heating/pressure-exerting station in the TAB bonding apparatus. This step (which may likewise be accomplished using other heating methods including external heating of the printhead 80) causes thermal adhesion of the internal components together (e.g. using the adhesive layer 164 shown in the embodiment of FIG. 2 and mentioned above). As a result, the printhead assembly process is completed at this stage.

The only remaining step involves cutting and separating the individual "frames" on the TAB strip (with each "frame" comprising an individual, completed printhead 80), followed by attachment of the printhead 80 to the housing 12 of the ink cartridge 10. Attachment of the printhead 80 to the housing 12 may be accomplished in many different ways. However, in a preferred embodiment illustrated schematically in FIG. 2, a portion of adhesive material 166 may be applied to either the mounting frame 56 on the housing 12 and/or selected locations on the bottom surface 112 of the orifice plate 104. The orifice plate 104 is then adhesively affixed to the housing 12 (e.g. on the mounting frame 56 associated with the outwardly-extending printhead support structure 34 shown in FIG. 1).

In accordance with the foregoing affixation process, the substrate 82 associated with the resistor assembly 96 is precisely positioned within the central cavity 50 as illustrated in FIG. 2 so that the substrate 82 is located within the center of the mounting frame 56 (discussed above and shown in FIG. 2). In this manner, the ink flow passageways 100, 102 (FIG. 2) are formed which enable ink materials to flow from the ink outlet port 54 within the central cavity 50 into the vaporization chambers 160 for expulsion from the cartridge 10 through the orifices 124 in the orifice plate 104.

To generate a printed image 170 (FIG. 1) on a selected image-receiving print medium 172 (typically made of paper, plastic, or metal) using the cartridge 10, a supply of an ink composition 174 (schematically illustrated in FIG. 1) which resides within the interior compartment 30 of the housing 12 passes into and through the ink outlet port 54 within the bottom wall 52 of the central cavity 50. Many different materials can be used in connection with the ink composition 174 including but not limited to those recited in U.S. Pat. No. 5,185,034 which is incorporated herein by reference. The ink composition 174 thereafter flows into and through the ink flow passageways 100, 102 in the direction of arrows 176, 180 toward the substrate 82 having the resistors 86 thereon. The ink composition 174 then enters the vaporization chambers 160 directly above the resistors 86. Within the chambers 160, the ink composition 174 comes in contact with the resistors 86. To activate (e.g. energize) the resistors 86, the printer system (not shown) which contains the cartridge unit 10 causes electrical signals to travel from the printer unit to the contact pads 120 on the top surface 110 of the orifice plate 104. The electrical signals then pass through vias (not shown) within the plate 104 and subsequently travel along the circuit traces 114 on the bottom surface 112 of the plate 104 to the resistor assembly 96 containing the resistors 86. In this manner, the resistors 86 can be selectively energized (e.g. heated) in order to cause ink vaporization and expulsion from the printhead 80 via the orifices 124 through the orifice plate 104. The ink composition 174 can then be delivered in a highly selective, on-demand basis to the selected image-receiving print medium 172 to generate an image 170 thereon (FIG. 1).

It is important to emphasize that the printing process discussed above is applicable to a wide variety of different thermal inkjet cartridge designs. In this regard, the inventive concepts discussed below shall not be restricted to any particular printing system. However, a representative, non-limiting example of a thermal inkjet cartridge of the type described above which may be used in connection with the claimed invention involves an inkjet cartridge sold by the Hewlett-Packard Company of Palo Alto, Calif. (U.S.A.) under the designation "51645A" Likewise, further details concerning thermal inkjet processes in general are again outlined in the *Hewlett-Packard Journal,* Vol. 39, No. 4 (August 1988), U.S. Pat. No. 4,500,895 to Buck et al., and U.S. Pat. No. 4,771,295 to Baker et al. (incorporated herein by reference).

Figure 3:
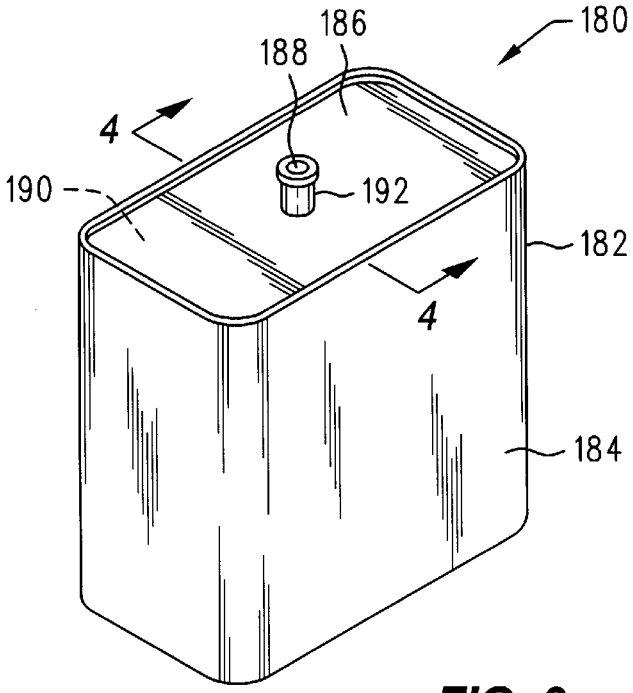
FIG. 3 is a schematically-illustrated perspective view of an ink containment vessel used in an alternative "off-axis"-type ink delivery system which may likewise be operatively connected to the printhead of the present invention.
Figure 4:
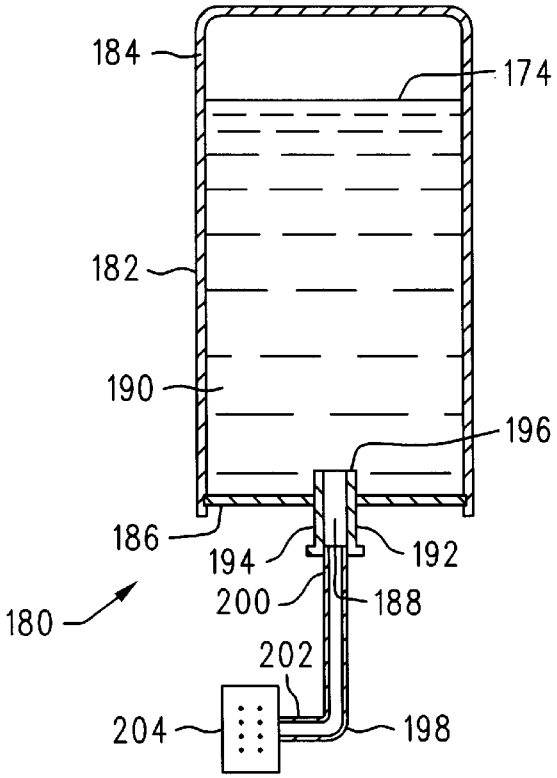
FIG. 4 is a partial cross-sectional view of the ink containment vessel shown in FIG. 3 taken along line 4—4.

The ink cartridge 10 discussed above in connection with FIG. 1 involves a "self-contained" ink delivery system which includes an "on-board" ink supply. The claimed invention may likewise be used with other systems which employ a printhead and a supply of ink stored within an ink containment vessel that is remotely spaced but operatively connected to and in fluid communication with the printhead. Fluid communication is typically accomplished using one or more tubular conduits. An example of such a system (which is known as an "off-axis" apparatus) is again disclosed in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 11, 1997) entitled "REGULATOR FOR A FREE-INK INKJET PEN" (Hauck et al.) which are both incorporated herein by reference. As illustrated in FIGS. 3–4, a representative off-axis ink delivery system is shown which includes a tank-like ink containment vessel 180 that is designed for remote operative connection (preferably on a gravity feed or other comparable basis) to a selected thermal inkjet printhead. Again, the terms "ink containment unit", "vessel", "housing", and "tank" shall be considered equivalent in this embodiment. The ink containment vessel 180 is configured in the form of an outer shell or housing 182 which includes a main body portion 184 and a panel member 186 having an inlet/outlet port 188 passing therethrough (FIGS. 3–4). While this embodiment shall not be restricted to any particular assembly methods in connection with the housing 182, the panel member 186 is optimally produced as a separate structure from the main body portion 184. The panel member 186 is thereafter secured to the main body portion 184 using known thermal welding processes or conventional adhesives (e.g. epoxy resin or cyanoacrylate compounds). However, the panel member 186 shall, in a preferred embodiment, be considered part of the overall ink containment vessel 180/housing 182.

With continued reference to FIG. 4, the housing 182 also has an internal chamber or cavity 190 therein for storing a supply of an ink composition 174. In addition, the housing 182 further includes an outwardly-extending tubular member 192 which passes through the panel member 186 and, in a preferred embodiment, is integrally formed therein. The term "tubular" as used throughout this description shall be defined to encompass a structure which includes at least one or more central passageways therethrough that are surrounded by an outer wall. The tubular member 192 incorporates the inlet/outlet port 188 therein as illustrated in FIG. 4 which provides access to the internal cavity 190 inside the housing 182.

The tubular member 192 positioned within the panel member 186 of the housing 182 has an upper section 194 which is located outside of the housing 182 and a lower section 196 that is located within the ink composition 174 in the internal cavity 190 (FIG. 4.) The upper section 194 of the tubular member 192 is operatively attached by adhesive materials (e.g. conventional cyanoacrylate or epoxy compounds), frictional engagement, and the like to a tubular ink transfer conduit 198 positioned within the port 188 shown schematically in FIG. 4. In the embodiment of FIG. 4, the ink transfer conduit 198 includes a first end 200 which is attached using the methods listed above to and within the port 188 in the upper section 194 of the tubular member 192. The ink transfer conduit 198 further includes a second end 202 that is operatively and remotely attached to a printhead 204 which may involve a number of different designs, configurations, and systems including those associated with printhead 80 illustrated in FIG. 1 which shall be considered equivalent to printhead 204. Likewise, it is important to note that the printheads 80, 204 may both include the novel orifice plate structures of the present invention as outlined in the next section. All of these components are appropriately mounted within a selected printer unit at predetermined locations therein, depending on the type, size, and overall configuration of the entire ink delivery system. Furthermore, the ink transfer conduit 198 may include at least one optional in-line pump of conventional design (not shown) for facilitating the transfer of ink.

The systems and components presented in FIGS. 1–4 are illustrative in nature. They may, in fact, include additional operating components depending on the particular devices under consideration. The information provided above shall not limit or restrict the present invention and its various embodiments. Instead, the systems of FIGS. 1–4 may be varied as needed and are presented entirely to demonstrate the applicability of the claimed invention to ink delivery systems which employ many different arrangements of components. In this regard, any discussion of particular ink delivery systems, ink containment vessels, and related data shall be considered representative only.

Having described conventional thermal inkjet components and printing methods associated therewith, the claimed invention and its beneficial features will now be presented.

B. The Novel Orifice Plate Structures of the Present Invention

As indicated above, the claimed invention involves a novel orifice plate structure which is particularly designed to avoid problems associated with "ruffling" as previously discussed and defined. Once again, this adverse condition occurs when the orifice plate is placed in contact with a moving or stationary object. For example, the sliding passage of an ink wiper over the orifice plate can cause this condition to take place. This contact results in a localized disruption of the orifice plate structure, with particular reference to the peripheral regions which surround the orifices (e.g. along the outer edges thereof). As a result, the geometry of the orifices at the top surface of the plate is changed. Likewise, ink "puddling" can occur adjacent sections of the orifice plate which are "uplifted". This "puddling" (which involves the collection of residual ink in discrete zones around the orifices) can interfere with the expelled ink drop as it passes out of the orifice, thereby causing ink drop trajectory problems. These problems typically result in undesired and uncontrolled changes in ink drop trajectory which degrade print quality. It is therefore highly desirable to avoid the conditions outlined above so that the longevity of the printhead and overall print quality can be maximized over the life of the printhead.

With reference to FIG. 2, a conventional orifice plate 104 is schematically illustrated. In this figure, a representative elastomeric ink wiper 210 made from, for example, rubber or plastic, is illustrated which is of a general type discussed in, for example, U.S. Pat. No. 5,786,830. The wiper 210 is in physical, dynamic (e.g. moving) engagement with the top surface 212 of the orifice plate 104. As shown in the FIG. 2, however, the physical action of the wiper 210 as it comes in contact with the peripheral edges 214 of the orifice 124 has caused a "ruffle" to be created in the form of an uplifted section 216. The presence of this uplifted section 216 will result in a substantial modification of the overall geometry of the orifice 124 in the plate 104 at the top surface 212 thereof. Likewise, the interior side wall 220 associated with the orifice 124 will be discontinuous and disrupted adjacent the top surface 212 of the orifice plate 104 (e.g. at position 222). This particular situation can again cause a number of problems including but not limited to uncontrolled changes in ink drop trajectory.

To avoid the difficulties outlined above, it has been discovered that the main opening (discussed below) leading into the orifice associated with the orifice plate under consideration can be "isolated" from the effects of wiper structures and the like by forming a "recess" (e.g. an indentation or indented region) in the top surface of the orifice plate directly above and in axial alignment with the remaining portions of the orifice. As a result, the main opening leading into the orifice will be "inset" and safely positioned below the plane on which any wipers and/or other physical objects pass during printhead operation. These features collectively contribute to the precise control of ink drop trajectory and the avoidance of other problems associated with "ruffling" as defined above.

Representative and preferred embodiments of the novel orifice plate member associated with the invention will now be discussed in detail. As previously noted, the present invention shall not be restricted to any specific construction materials, numerical size parameters, shapes, and the like in connection with the claimed orifice plate unless otherwise stated herein.

Figure 5:
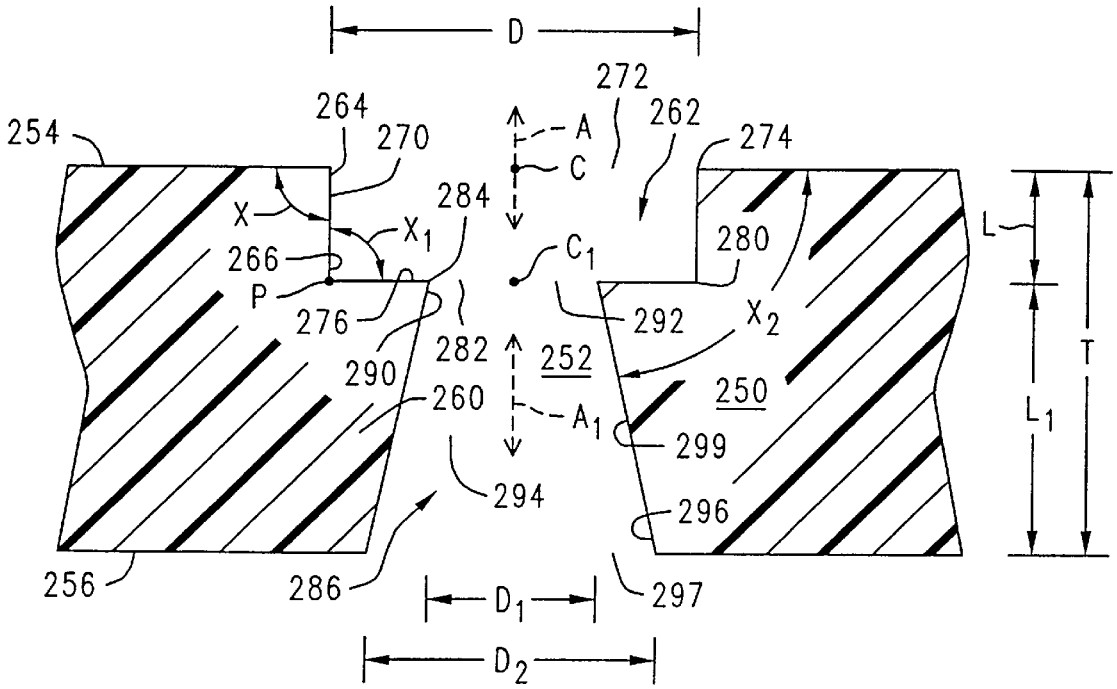
FIG. 5 is a schematically illustrated, enlarged partial cross-sectional view of an organic polymer-based thin-film orifice plate structure showing one of the orifices through the plate in a preferred embodiment of the present invention.

With reference to FIG. 5, an enlarged, partial cross-sectional view of a representative orifice plate 250 (also characterized herein as an "orifice plate member" 250) produced in accordance with a preferred embodiment of the invention is illustrated. The orifice plate 250 is manufactured from an organic polymer (e.g. plastic) thin-film composition with the representative materials discussed above in connection with orifice plate 104 being applicable to the orifice plate 250. In FIG. 5, a single orifice 252 is shown with the understanding that the plate 250 will optimally include a substantial number of orifices therein, some or (preferably) all of which will have the claimed structural features. Regarding the construction materials, organic character of the plate 250 (with or without metal atoms associated therewith), number of orifices, and other features of the orifice plate 250 (aside from novel elements described in this section [Section "B"]), all of these items will be substantially the same as those discussed above in Section "A" in connection the polymeric orifice plate 104. In this regard, technical information concerning construction materials and the other features listed above relative to orifice plate 104 shall be incorporated by reference in connection with orifice plate 250 unless otherwise stated. As will become readily apparent from the following discussion, the primary difference between conventional orifice plate 104 and the orifice plate 250 of the present invention concerns the structural configuration of the orifices 252 within the plate 250 as outlined in considerable detail below.

With continued reference to FIG. 5, the orifice plate 250 includes a top surface 254, a bottom surface 256, and a medial region 260 between the top surface 254 and bottom surface 256. In a preferred and non-limiting embodiment, both the top and bottom surfaces 254, 256 are substantially parallel to each other as illustrated. As previously stated, it is important to accurately characterize and orient the top and bottom surfaces 254, 256 relative to the other components in the printhead 80/orifice plate 250. The term "top surface" as used and claimed herein shall be defined to involve the particular surface associated with the orifice plate 250 that is outermost and, in effect, constitutes the "exterior" surface of the orifice plate 250/printhead 80 that is exposed to the external (outside) environment. It is the last "surface" that the ink composition 174 will pass through on its journey to the selected print media material (print medium 172). Likewise, it is the surface that is "wiped" using one or more wiping members (including the wiper 210 of FIG. 2) that are employed in conventional printing units as disclosed, for example, in U.S. Pat. No. 5,786,830.

In contrast, the term "bottom surface" as used in connection with the orifice plate 250 is the specific surface which is positioned within (e.g. inside) the printhead 80 and is the initial surface of the orifice plate 250 through which the ink composition 174 passes as it is being expelled. The bottom surface 256 is the innermost (e.g. "unexposed") surface of the orifice plate 250 which, in effect, is located between the top surface 254 of the orifice plate 250 and the substrate 82 having the ink ejector(s)/resistor(s) 86 thereon. Finally, the bottom surface 256 is the specific surface of the orifice plate 250 which is adhered to the underlying printhead components including the ink barrier layer 156 (FIG. 2) as discussed above. Having presented these specific definitions of the top and bottom surfaces 254, 256 of the orifice plate 250 which define the orientation of the plate 250 relative to the remainder of the printhead 80, the novel features of the claimed orifice plate 250 will now be addressed.

In order to provide the substantial benefits outlined herein (including but not limited to the avoidance of "ruffling"-related problems and the maintenance of proper ink drop trajectory), the novel orifice plate 250 includes least one "recess" 262 (indented region/indentation) therein which begins at the top surface 254 of the plate and terminates at a position "P" within the orifice plate 250 between the top surface 254 and the bottom surface 256 thereof (e.g. within the medial region 260 as shown in FIG. 5). The recess 262 includes an upper end 264 (which is located at and flush with the top surface 254 of the plate 250) and a lower end 266 (located substantially at position "P" in the medial region 260). In addition, the recess 262 further includes an interior side wall 270 which defines the internal boundaries of the recess 262, with the side wall 270 extending continuously (preferably in uninterrupted fashion) between the upper end 264 and the lower end 266 of the recess 262. In the preferred embodiment of FIG. 5 which is designed to provide effective results, the side wall 270 is oriented at an angle "X" of about 90° (approximately a "right angle") relative to the top surface 254 of the orifice plate 250. Likewise, in accordance with this relationship and in the embodiment of FIG. 5, the side wall 270 will be substantially perpendicular to the top surface 254 of the orifice plate 250 and vice versa as shown.

Figure 6:
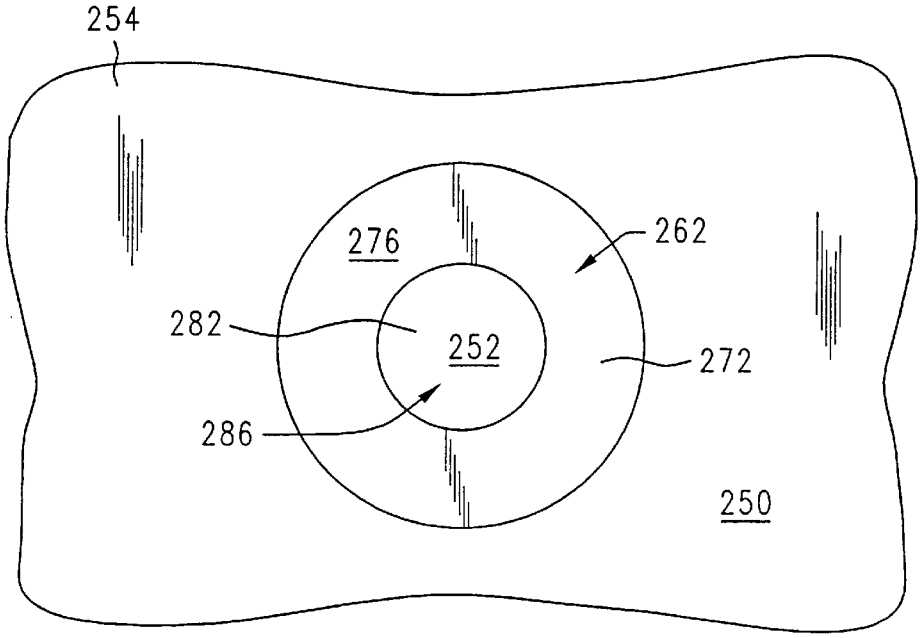
FIG. 6 is a top view of the orifice plate structure of FIG. 5 looking downwardly into the claimed recess.

The cross-sectional configuration of the recess 262 may be varied as needed and desired without limitation. In particular, it may involve a number of different configurations without restriction including but not limited to those which are square, triangular, oval-shaped, circular (preferred as illustrated in FIG. 6), or any other regular or irregular shape. The remainder of this discussion (including the following description of additional embodiments) shall involve a circular recess 262 with the understanding that other configurations are possible. While it is preferred that the recess 262 have a uniform cross sectional shape (e.g. circular, square, etc.) along its entire length from the upper end 264 to the lower end 266, it is also possible for a shape change to occur one or more times at any position along the length/depth of the recess 262 if desired.

The upper end 264 of the recess 262 at the top surface 254 of the orifice plate 250 has a first hole or opening 272 therein. The first opening 272 (with particular reference to the peripheral edges 274 thereof) is optimally flush with the top surface 254 of the orifice plate 250. Again, the present invention shall not be restricted to any particular shape or configuration in connection with the first opening 272 which may be circular (preferred as illustrated in FIG. 6), square, oval, triangular, or any other regular or irregular shape. The function of the first opening 272 will be discussed in greater detail below.

As illustrated in FIGS. 5–6, the lower end 266 of the recess 262 in the orifice plate 250 further comprises (in a preferred and non-limiting embodiment) a bottom wall 276 which is optimally planar in configuration. In the representative embodiment of FIG. 5, the bottom wall 276 is preferably oriented at an angle "$X_1$" of about 90° (approximately a right angle) relative to the side wall 270 and is therefore substantially perpendicular thereto. In this configuration, the bottom wall 276 will be substantially parallel to the top surface 254 (and the bottom surface 256) of the orifice plate 250 as shown. Likewise, in the preferred and non-limiting embodiment of FIG. 5, the bottom wall 276 is substantially the same size/area as the first opening 272 so that the peripheral edges 274 of the first opening 272 are directly above the outer edge portions 280 of the bottom wall 276 as illustrated in FIG. 5. While the right angle (approximately 90°) relationship between (1) the bottom wall 276 and the side wall 270; and (2) the side wall 270 and the top surface 254 of the claimed orifice plate 250 is again preferred, it shall be understood that this geometric relationship may be varied as indicated below in accordance with a number of alternative embodiments.

In the orifice plate 250 illustrated in FIGS. 5–6, the recess 262 will have a substantially cylindrical or disk-shape which again is designed to produce highly-effective results in the present invention. The length "L" associated with the recess 262 in the embodiment of FIGS. 5–6 (which may also be characterized as the depth of the recess 262 if desired) may be varied without limitation as determined in accordance with routine preliminary pilot testing involving numerous considerations including the type of printing system in which the printhead 80 will be employed and other extrinsic factors. However, in a preferred and non-limiting embodiment, the length "L" of the recess 262 will be about 1–3 $\mu$m (which, again, is subject to change as needed). In the system of FIG. 5, the length "L" will actually involve the distance between point "P" as referenced above and the top surface 254 of the orifice plate 250. Incidentally, it should be noted that the overall thickness "T" of the orifice plate 250 will, in a preferred embodiment applicable to all versions of the claimed invention described herein, be about 25–50 $\mu$m although other values may be employed if desired.

Located at the lower end 266 of the recess 262 within the orifice plate 250 is a second hole or opening 282 having peripheral edges 284. In the preferred embodiment of FIGS. 5–6, the second opening 282 passes through the bottom wall 276 and is optimally in the center thereof as illustrated (although the second opening 282 may be placed at any non-centered position within the bottom wall 276 if necessary). In the preferred orientation of FIGS. 5–6, the center point "C" of the first opening 272 is in axial alignment (e.g. directly above) the center point "$C_1$" of the second opening 282. Likewise, the second opening 282 is optimally flush with the bottom wall 276 at the lower end 266 of the recess 262 as illustrated. The present invention shall not be restricted to any particular shape or configuration in connection with the second opening 282 which may be circular (preferred as illustrated in FIG. 6), square, oval, triangular, or any other regular or irregular shape. While best results are obtained if the cross-sectional shape of the first opening 272 and the second opening 282 are both the same (e.g. circular as in the embodiment of FIGS. 5–6), both openings 272, 282 may have different shapes relative to each other if needed and desired in accordance with routine preliminary testing.

As previously discussed, the second opening 282 basically functions as the "main opening" associated with the orifice 252 through which the ink composition 174 passes on its way to the print medium 172 (FIG. 1). It is an important feature of the present invention which is common to all of the listed embodiments that the second opening 282 (e.g. the "main opening") be positioned below the top surface 254 of the orifice plate 250 to avoid being placed in contact with ink wiping members (e.g. wiper 210) or other objects which may pass along the top surface 254 of the orifice plate 250. In accordance with the "protected" position occupied by the second opening 282 as described herein, it cannot be disfigured or otherwise "ruffled" by passage of the foregoing objects along the top surface 254 of the plate 250.

At this point, further information regarding the relationship between the first opening 272 and the second opening 282 is warranted. Basically, the first opening 272 and the second opening 282 are separated from each other by a distance which is defined by the length "L" as previously discussed. In addition, a novel feature of the claimed invention which is likewise generally applicable to all of the embodiments described in this section is the size relationship of the first opening 272 relative to the second opening 282. Basically, the first opening 272 is larger in size than the second opening 282, with the second opening 282 again being "inset" in accordance with the design described above. The term "larger in size" as used in connection with the first and second openings 272, 282 basically involves a situation in which the cross-sectional area of the first opening 272 exceeds the cross-sectional area of the second opening 282, with the term "area" being defined conventionally, depending on the shape of the opening under consideration. For example, in situations involving square or rectangular openings 272, 282, the cross-sectional area will involve the length of the opening 272 and/or opening 282 multiplied by its width. In an orifice plate 250 which includes circular first and second openings 272, 282, the cross-sectional area thereof will be defined conventionally to involve the formula "$\pi r^2$" wherein r=the radius of the opening 272 and/or opening 282. Likewise, in situations involving openings 272, 282 having other shapes (e.g. triangles, ovals, etc.) the "conventional" formulae that are normally used to calculate the area of these shapes would be employed.

When circular first and second openings 272, 282 are employed as shown in, for example, FIGS. 5–6 (which are preferred for numerous reasons including ease of production, the absence of angled surfaces, and the like), the term "larger in size" may also be defined relative to the comparative diameter of each opening 272, 282. With reference to the preferred embodiment of FIG. 5, the first opening 272 and the second opening 282 are both completely circular in cross-section as noted above, with the first opening 272 having a first diameter "D" and the second opening 282 having a second diameter "$D_1$". It shall be understood that all of the drawing figures and length/diameter dimensions shown therein are not necessarily drawn to exact scale and may therefore be varied as needed. In this particular non-limiting embodiment, the first diameter "D" of the first opening 272 will preferably be at least about 40 $\mu$m or more longer (e.g. larger/greater) than the second diameter "$D_1$" of the second opening 282. A proportionately comparable value will likewise be applicable to situations in which the relative sizes of the first and second openings 272, 282 are based on cross-sectional area as previously discussed. Furthermore, in a representative and non-limiting embodiment, the first diameter "D" associated with the first opening 272 will be about 50–80 $\mu$m, with the second diameter "$D_1$" of the second opening 282 being about 10–40 $\mu$m. However, as previously indicated, the claimed invention shall not be restricted to this numerical range or any other numerical parameters unless otherwise stated herein. Such values shall therefore be considered representative and non-limiting.

By using a first opening 272 which is larger than the second opening 282 in all of the various embodiments described in this section, the transmission of physical forces from the top surface 254/first opening 272 of the orifice plate 250 to the bottom wall 276/second opening 282 within the recess 262 is minimized due to the structural relationships and size differential between these components. While the exact physical mechanisms by which these benefits occur are not entirely understood, they are nonetheless important and provide excellent results. In particular, the size relationship discussed above in which the first opening 272 is larger in size than the second opening 282 effectively facilitates proper ink drop trajectory. Any deformities associated with the peripheral edges 274 of the first opening 272 (FIG. 5) at the top surface 254 of the orifice plate 250 caused by wiping or other physical abrasion processes (e.g. "ruffling") will not adversely affect the trajectory of the ink drop leaving the second opening 282. Specifically, ink drop trajectory will remain unaffected in view of the larger size of the first opening 272 relative to (1) the second opening 282; and (2) the ink drop passing through the first opening 272, with the size of the ink drop basically being defined by the size of the second opening 282. The ink drop will be sufficiently small in accordance with its initial passage through the second opening 282 to avoid coming in substantial contact with the enlarged first opening 272 (and the peripheral edges 274 associated therewith.) Any "ruffles" in the peripheral edges 274 of the first opening 272 will therefore not present ink trajectory problems in view of the "inset" nature of the second opening 282.

Other important characteristics associated with the recess 262 in this embodiment of the invention (from a functional standpoint) include the orientation of the side wall 270 at an angle "X" of about 90° (approximately a right angle) relative to the top surface 254 of the orifice plate 250. This design provides a high degree of structural integrity/rigidity and enables physical forces applied to the top surface 254 of the orifice plate 250 to be effectively confined to this region without substantial transmission into the recess 262, bottom wall 276, and second opening 282. Use of the bottom wall 276 and its orientation at an angle "$X_1$" of about 90° (approximately a right angle) relative to the side wall 270 likewise provides additional reinforcement of the orifice plate 250 so that the structural integrity of the second opening 282 is maintained even when the top surface 254 of the orifice plate 250 is subjected to physical force.

With continued reference to FIG. 5, another important component of the orifice 252 in the orifice plate 250 involves an elongate ink transfer bore 286. The ink transfer bore 286 is positioned beneath the recess 262 and is in fluid communication therewith. The ink transfer bore 286 is in partial or (preferably) complete axial alignment with the recess 262 and vice versa as previously discussed. This relationship is illustrated in FIG. 5, wherein the longitudinal center axis "A" of the recess 262 is in substantially complete alignment and coterminous with the longitudinal center axis "Al" of the bore 286. As a result of this preferred structural relationship, ink materials (ink composition 174) which are expelled by the ink ejector(s)/resistor(s) 86 will initially pass upwardly, enter the bore 286, pass through the recess 262, and exit the orifice plate 250/printhead 80 for delivery to the desired print medium 172.

To accomplish this goal and from a functional standpoint, the ink transfer bore 286 again begins at the lower end 266 of the recess 262 (e.g. at the second opening 282 therein). The second opening 282 of the recess 262 actually comprises the upper end 290 of the bore 286 with both components meeting each other at this point (e.g. position "P" in FIG. 5). The upper end 290 of the bore 286 comprises a third opening 292 therein which, in reality, is the same as and equivalent to the second opening 282 in the recess 262. Accordingly, all of the information, size parameters, and the like associated with the second opening 282 are equally applicable and incorporated by reference relative to the third opening 292 (which is not separately discernable/separable from a visual standpoint with respect to the second opening 282.)

The bore 286 also includes a medial section 294 which continues downward through the orifice plate 250 as illustrated and ultimately terminates at the bottom surface 256 of the plate 250. As shown in FIG. 5, the bore 286 terminates at a lower end 296 which includes a fourth opening 297 therein that is substantially flush with the bottom surface 256 of the orifice plate 250. The fourth opening 297 is the lowermost opening in the entire orifice 252/orifice plate 250 and is the first part of the orifice 252 to receive the thermally-excited ink composition 174 during the ink expulsion process. The claimed invention shall not be limited in connection with the size and shape of the fourth opening 297 which may be varied as needed and desired in accordance with routine preliminary pilot testing. For example, the cross-sectional configuration of the fourth opening 297 may be circular (preferred), square, oval, triangular, or any other regular or irregular shape depending on many factors including the intended use of the printhead 80. In a preferred embodiment wherein the fourth opening 297 is completely circular in shape, it will have a representative and non-limiting diameter "$D_2$" of about 20–80 $\mu$m with the understanding that this range is provided for example purposes only.

Again, the orifice plates 250 in all of the embodiments presented herein shall not be restricted to any particular numerical dimension, diameter, or area values. However, in a representative and non-limiting embodiment involving circular first, second, third, and fourth openings 272, 282, 292, 297, the following example relationships will provide excellent results: (1) $D_1$=10–40 $\mu$m; (2) $D=D_1+40$ $\mu$m; and (3) $D_2=2(D_1)$.

While a number of different structural designs may be employed in connection with the ink transfer bore 286, the bore 286 is optimally uniform in cross-sectional shape along its entire length. However, the bore 286 may be configured so that it changes cross-sectional shape one or more times at any position(s) along the length thereof. Representative cross-sectional configurations associated with the bore 286 include but are not limited to circular (preferred), square, oval, triangular, or any other regular or irregular shape. As illustrated in FIG. 5, the ink transfer bore 286 further includes a continuous interior side wall 299 which establishes the confines of the bore 286 within the medial region 260 of the orifice plate 250. In a preferred embodiment, the side wall 299 will be oriented so that it forms an acute angle "$X_2$" relative to the top surface 254 of the orifice plate 250, with the term "acute" angle again being defined to involve an angle of less than 90° (about 25–75° being preferred in a non-limiting fashion). However, in an alternative embodiment which shall not limit the invention in any respect, the angle "$X_2$" may, in fact, be 90° or greater if needed and desired. Thus, in a representative, non-restrictive embodiment, a broad angular range of about 25–145° (or even greater than 145°) can be employed in connection with angle "$X_2$".

The use of an acute angle "$X_2$" in connection with the side wall 299 of the ink transfer bore 286 is preferred for a number of reasons including ease of manufacture using mass production fabrication techniques involving laser ablation and the like. This angular orientation forms a bore 286 which is substantially cone-shaped (more specifically, a truncated cone or frustoconical configuration) having an enlarged fourth opening 297 therein which is larger in size compared with the third opening 292. The term "larger in size" as used in connection with the third and fourth openings 292, 297 shall be defined in an equivalent manner relative to the relationship between the first and second openings 272, 282. In accordance with this design, ink materials (e.g. ink composition 174) readily enter the bore 286 during the ink expulsion process (which particular reference to the enlarged fourth opening 297 which facilitates this process). However, the selection of any given internal design relative to the claimed ink transfer bore 286 and recess 262 in the top surface 254 of the orifice plate 250 may again be determined using routine preliminary pilot testing taking into account the factors recited above including the ultimate use associated with the printhead 80, the chosen construction materials, and the like.

Regarding the overall length of the ink transfer bore 286, the invention shall not be restricted to any particular values. In a representative embodiment designed to provide optimum functional capabilities, the bore 286 will have an exemplary length "$L_1$" of about 24–47 $\mu$m which is again subject to change as needed.

Figure 7:
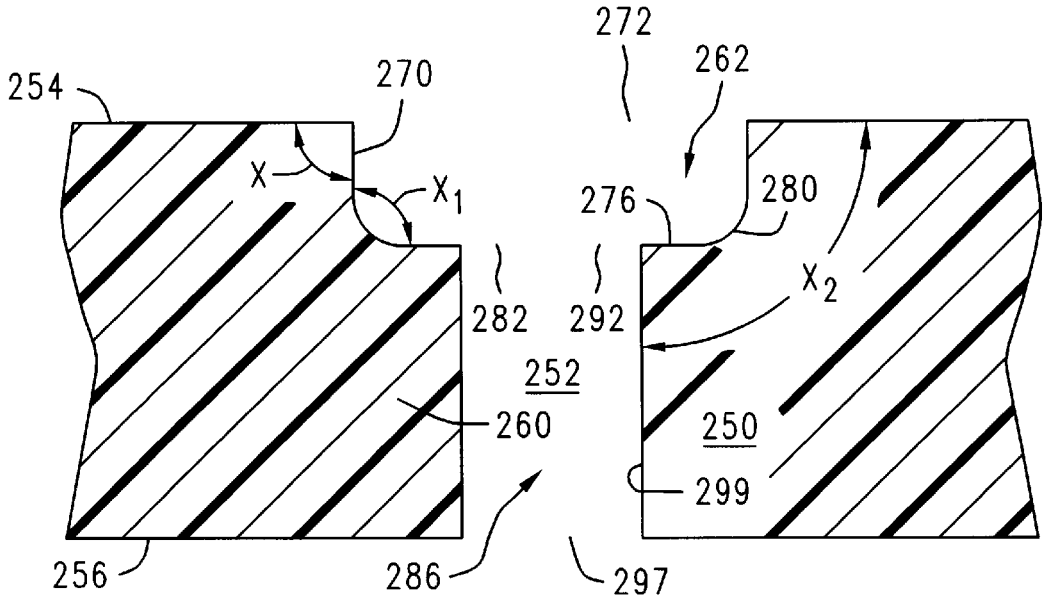
FIG. 7 is a schematically illustrated, enlarged partial cross-sectional view of an organic polymer-based orifice plate structure showing one of the orifices through the plate in an alternative embodiment.

Having described the preferred embodiment of FIGS. 5–6, it is important to emphasize that all of the angular and dimensional relations listed above shall not restrict the invention in any respect and instead constitute exemplary values which are presented as preferred versions of the invention. Many other variations are possible within the scope of the invention provided that the claimed orifice plate 250 having the recess 262 and bore 286 therein offer the desired functional capabilities discussed above. For example, as illustrated in FIG. 7, an internal side wall 299 associated with the ink transfer bore 286 is provided in which (1) angle "$X_2$" is about 90° (approximately a right angle); and (2) the side wall 270/bottom wall 276 (with particular reference to the outer edge portions 280 thereof) have been "smoothed" to form a bottom wall-containing recess 262 which is substantially "cup-shaped." It should be noted that either or both of the two items listed above may be incorporated into the embodiment of FIG. 5 (or any other embodiment herein if needed and desired). In fact, all of the variations/modifications outlined in this section (Section "B") can be incorporated within the orifice plate 250 in various combinations and permutations without restriction. Some additional alternatives will now be discussed which are likewise encompassed within the present invention as claimed with the understanding that the invention shall not be restricted to only the alternatives outlined below.

Figure 8:
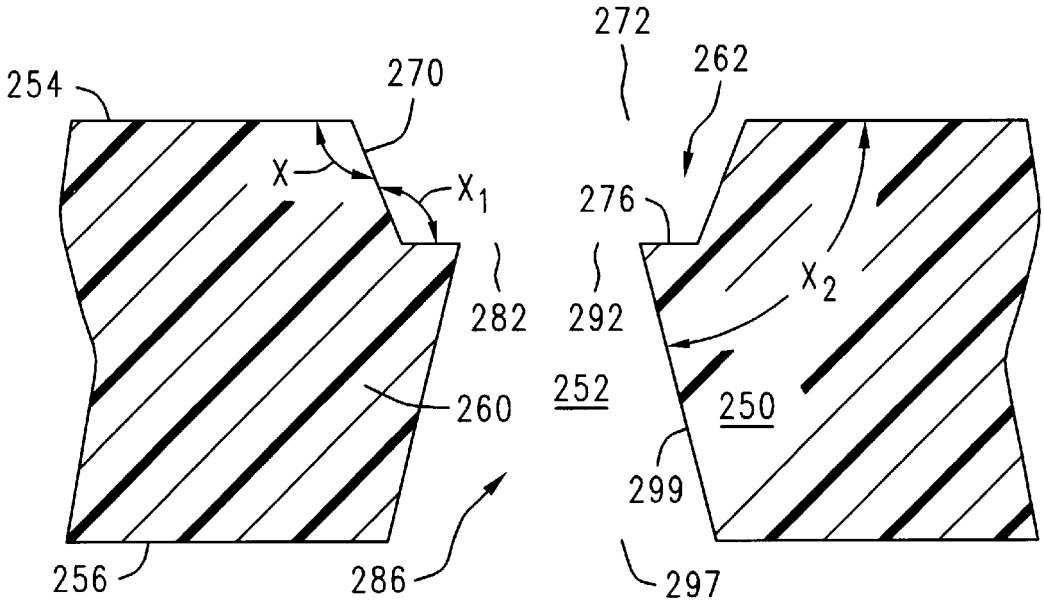
FIG. 8 is a schematically illustrated, enlarged partial cross-sectional view of an organic polymer-based orifice plate structure showing one of the orifices through the plate in a further alternative embodiment.

With reference to FIG. 8, a further alternative embodiment of the invention is schematically illustrated. All of the information, materials, numerical parameters, functional characteristics, operational features, and other aspects of the embodiments of FIGS. 5–7 are equally applicable to the embodiment of FIG. 8 (except for the particular modifications provided below). The specific information associated with the embodiments of FIGS. 5–7 is therefore incorporated by reference relative to the orifice plate 250 of FIG. 8. However, the orifice plate 250 illustrated in the embodiment of FIG. 8 has been modified regarding the angular relationship between (1) the side wall 270 associated with the recess 262; and (2) the top surface 254 of the orifice plate 250. Specifically, the angle "X" in the embodiment of FIG. 8 has been expanded to exceed 90°, thereby forming an "obtuse" angle. An obtuse angle is again generally defined to involve an angle which is greater than 90°. While the present invention shall not be restricted to any particular obtuse angles in this case, it is preferred that the angle "X" associated with this embodiment be about 100–145° in order to produce the orifice plate 250 shown in FIG. 8. This structure again provides a number of important benefits including "isolation" of the second opening 282 within the recess 262 in accordance with the "inset" nature of the second opening 282. Likewise, when considering both of the embodiments illustrated in FIGS. 5 and 8, it can be stated in a general manner that a representative broad range associated with angle "X" is about 90–145° (which includes the right angle relationship of FIG. 5 and the preferred obtuse angle relationship of FIG. 8).

With continued reference to the alternative embodiment of FIG. 8, the first opening 272 will be even larger than the first opening 272 shown in FIGS. 5–6 and described above. The extent to which the first opening 272 is enlarged in accordance with the embodiment of FIG. 8 will vary, depending on the obtuse angle "X" that is selected for use in the orifice plate 250. The overall size of the first opening 272 (as well as its shape as previously discussed) shall not be limited provided that the first opening 272 is, in fact, larger in size (defined above) than the second opening 282. However, it is anticipated that implementation of the embodiment of FIG. 8 in accordance with the general information provided above will result in a typical, non-limiting increase in the size of the first opening 272 (e.g. the cross-sectional area and/or diameter) by about 10–50% compared with the size of the first opening 272 in the embodiment of FIGS. 5–6. However, this range is representative only and shall not limit the invention in any respect. The overall length/depth of the recess 262 in the embodiment of FIG. 8 may be adjusted as needed or desired, preferably within the "L" value range listed above in connection with the system of FIGS. 5–6 or greater if needed. The desired parameters associated with all of the variables in the present embodiment (with particular reference to "L", "X", and "$X_1$") will be determined in accordance with routine preliminary pilot testing taking into account a number of items including the other components which are employed to manufacture the printhead 80, as well as the manner in which the printhead 80 is going to be used.

Finally, in the present embodiment shown in FIG. 8, the angle "$X_1$" which defines the relationship between (1) the bottom wall 276; and (2) the side wall 270 will also become "obtuse" as previously defined, namely, in excess of 90°. While the claimed invention shall not be restricted to any given values in connection with angle "$X_1$", this angle will generally be equivalent to the value associated with angle "X" (assuming that the bottom wall 276 remains substantially parallel with the top surface 254 of the orifice plate 250 as illustrated in FIG. 8 (which is not necessarily required but preferred). For example, if angle "X" is 120°, then angle "$X_1$" will also be 120°, again assuming that a substantially parallel relationship is maintained between the bottom wall 276 and the top surface 254 of the orifice plate 250. However, it should again be emphasized that the embodiment of FIG. 8 (and the numerical values recited above) are representative only and shall not limit the invention in any respect. Regarding the configuration of the ink transfer bore 286, this portion of the orifice 252 may have the features recited above in connection with the embodiments of FIGS. 5–7, with the data associated therewith being incorporated by reference relative to the system of FIG. 8.

Figure 9:
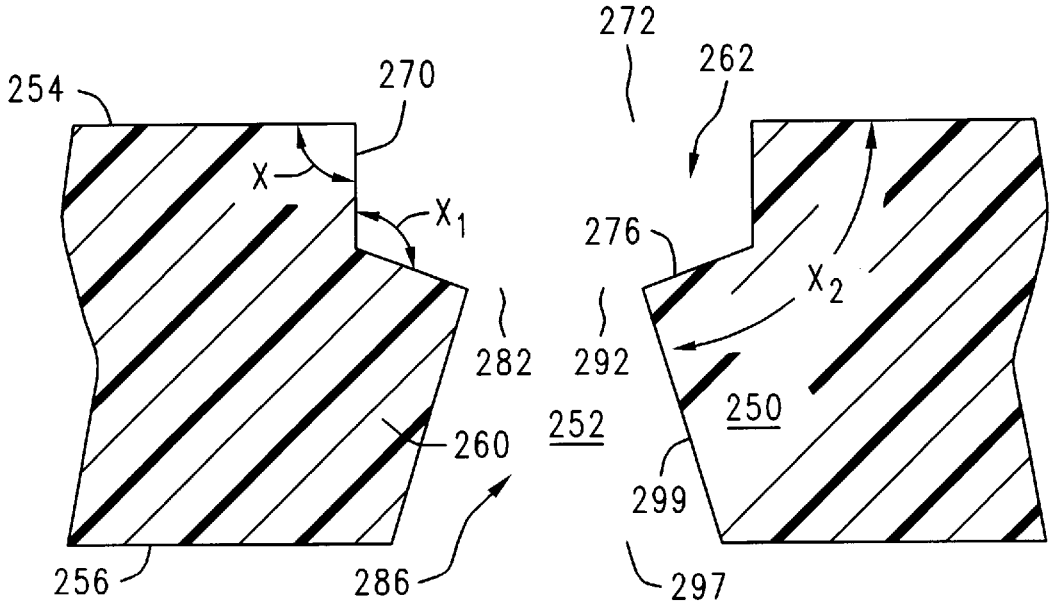
FIG. 9 is a schematically illustrated, enlarged partial cross-sectional view of an organic polymer-based orifice plate structure showing one of the orifices through the plate in a still further alternative embodiment.

FIG. 9 illustrates a still further embodiment of the invention. All of the information, materials, numerical parameters, functional characteristics, operational features, and other aspects of the embodiments of FIGS. 5–8 are equally applicable to the embodiment of FIG. 8 (except for the particular modifications provided below). The specific information associated with the embodiments of FIGS. 5–8 is therefore incorporated by reference relative to the system of FIG. 9. Regarding the embodiment of FIG. 9, it differs from the system of FIGS. 5–6 with respect to the angular relationship between (1) the bottom wall 276 within the recess 262; and (2) the side wall 270 in the recess 262. Specifically, the angle "$X_1$" between both of these components is of an obtuse nature as previously defined, namely, in excess of 90°. At the same time, the angle "X" relative to the side wall 270 and the top surface 254 of the orifice plate 250 remains at about 90° (approximately a right angle) in accordance with the system of FIGS. 5–6. While this particular embodiment shall not be restricted to any given obtuse angle "$X_1$" (with a number of variations being possible), a representative and preferred range associated with angle "$X_1$" in the embodiment of FIG. 9 will be about 100–145°. Even though the angle "X" is optimally about 90° (approximately a right angle) as previously noted, it should be emphasized that angle "X" may also be greater than this value, with the obtuse angle values expressed above in connection with the embodiment of FIG. 8 likewise being applicable and incorporated by reference relative to the system of FIG. 9 if desired. Furthermore, in the orifice plate 250 of FIG. 9, the bottom wall 276 is no longer parallel with the top surface 254 of the orifice plate 250.

The overall length/depth of the recess 262 in the embodiment of FIG. 9 (as measured from the top surface 254 of the orifice plate 250 to the second opening 282) may be adjusted as needed or desired, preferably within the "L" value range listed above in connection with the system of FIGS. 5–6 or greater if needed. The desired parameters associated with all of the variables in the present embodiment (with particular reference to "L", "X" and "$X_1$") will be determined in accordance with routine preliminary pilot testing taking into account a number of items including the other components which are employed to manufacture the printhead 80, as well as the manner in which the printhead 80 is going to be used.

With continued reference to FIG. 9, the first and second openings 272, 282 in this version of the claimed orifice plate 250 will optimally remain mostly the same from a size standpoint relative to the initial embodiment of FIGS. 5–6, although the size values associated with these elements may be modified as necessary. Regarding the configuration of the ink transfer bore 286 in FIG. 9, this portion of the orifice 252 may have the features recited above in connection with the embodiments of FIGS. 5–8, with the data associated therewith being incorporated by reference in the system of FIG. 9. Finally, the orifice plate 250 of FIG. 9 again provides a number of important benefits including "isolation" and protection of the second opening 282 within the recess 262 in accordance with the "inset" nature of the second opening 282.

Figure 10:
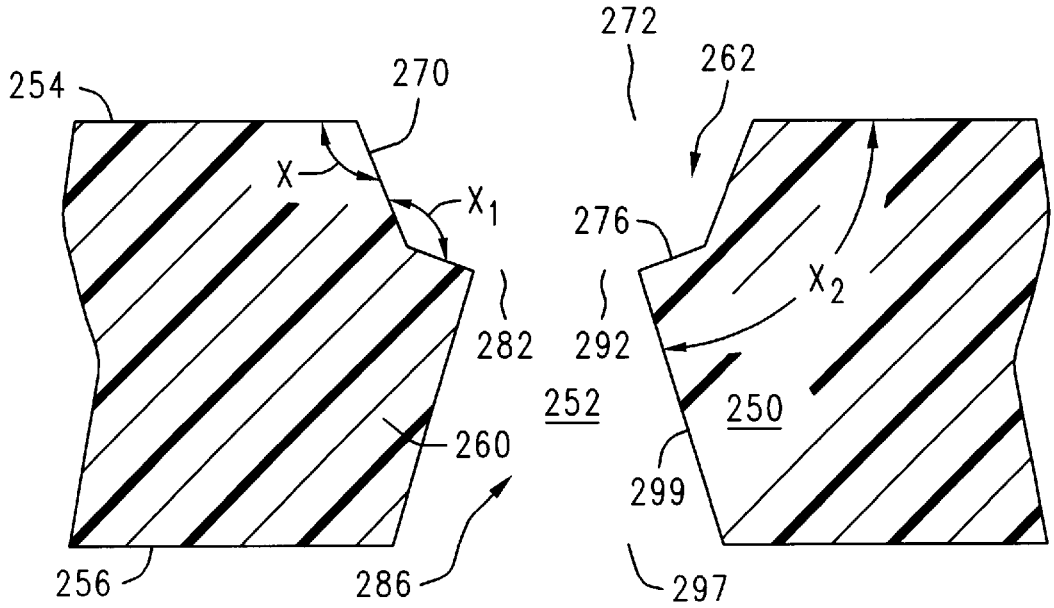
FIG. 10 is a schematically illustrated, enlarged partial cross-sectional view of an organic polymer-based orifice plate structure showing one of the orifices through the plate in a still further alternative embodiment.

With reference to FIG. 10, a further alternative embodiment of the invention is schematically illustrated. All of the information, materials, numerical parameters, functional characteristics, operational features, and other aspects of the embodiments of FIGS. 5–9 are equally applicable to the embodiment of FIG. 10 (except for the particular modifications listed below). The specific information associated with the embodiments of FIGS. 5–9 is therefore incorporated by reference relative to the orifice plate 250 of FIG. 10. However, the orifice plate 250 illustrated in the embodiment of FIG. 10 has been further modified regarding the angular relationship between (1) the side wall 270 associated with the recess 262; and (2) the top surface 254 of the orifice plate 250. Specifically, the angle "X" in the embodiment of FIG. 10 has been expanded to exceed 90°, thereby forming an "obtuse" angle as defined above. While the present invention shall not be restricted to any particular obtuse angles in this case, it is preferred that the angle "X" associated with this embodiment (FIG. 10) be about 100–145° in order to produce the structure of FIG. 10. Likewise, the orifice plate 250 illustrated in FIG. 10 has been further modified regarding the angular relationship between (1) the bottom wall 276 in the recess 262; and (2) the side wall 270 of the recess 262. Specifically, the angle "$X_1$" associated with this embodiment has been expanded to exceed 90°, thereby also forming an "obtuse" angle as previously defined. While the present invention shall not be restricted to any particular obtuse angles in this case, it is preferred that the angle "$X_1$" associated with this embodiment (FIG. 10) be about 120–165° in order to fabricate the orifice plate 250 of FIG. 10. Likewise, the angle "$X_1$" associated with the structure of FIG. 10 should be sufficient to render the bottom wall 276 non-parallel and downwardly-sloped relative to the top surface 254 of the orifice plate 250. This design again provides a number of important benefits including "isolation" and protection of the second opening 282 within the recess 262 in accordance with the "inset" nature of the second opening 282.

With continued reference to the alternative embodiment of FIG. 10, the first opening 272 will be larger than the first opening 272 shown in FIGS. 5–6 and described above. The extent to which the first opening 272 is enlarged in the system of FIG. 10 will vary, depending on the obtuse angle "X" that is selected for use in the orifice plate 250. The overall size of the first opening 272 (as well as its shape as previously discussed) shall not be limited provided that the first opening 272 is, in fact, larger in size (defined above) than the second opening 282. However, it is anticipated that implementation of the embodiment of FIG. 10 in accordance with the general information provided above will result in a typical, non-limiting increase in the size of the first opening 272 (e.g. cross-sectional area and/or diameter) by about 10–50% compared with the size of the first opening 272 in the embodiment of FIGS. 5–6. However, this range is representative only and shall not limit the invention in any respect. The overall length/depth of the recess 262 in the orifice plate 250 of FIG. 10 (as measured from the top surface 254 of the plate 250 to the second opening 282) may be adjusted as needed or desired, preferably within the "L" value range listed above in connection with the system of FIGS. 5–6 or greater if necessary. The desired parameters associated with all of the variables in the present embodiment (with particular reference to "L", "X", and "$X_1$") will again be determined in accordance with routine preliminary pilot testing taking into account a number of items including the other components which are employed to manufacture the printhead 80, as well as the manner in which the printhead 80 is going to be used.

It should again be emphasized that the embodiment of FIG. 10 (and the numerical values recited above) are representative only and shall not limit the invention in any respect. Regarding the configuration of the ink transfer bore 286 in FIG. 10, this portion of the orifice 252 may have the features recited above in connection with the embodiments of FIGS. 5–9, with the data associated therewith being incorporated by reference relative to the system of FIG. 10.

Figure 11:
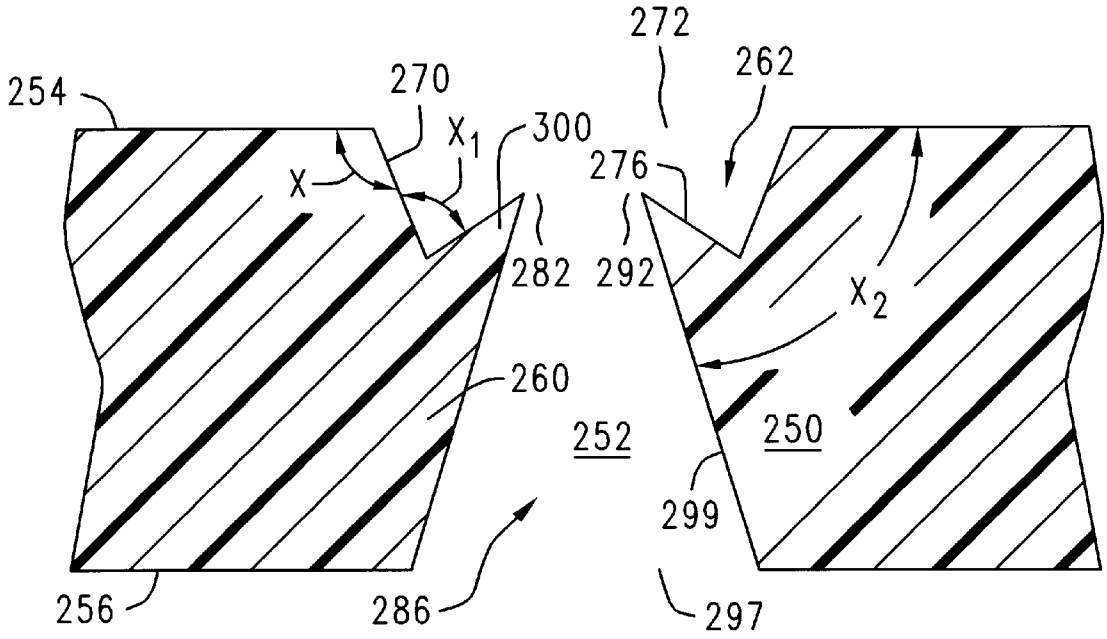
FIG. 11 is a schematically illustrated, enlarged partial cross-sectional view of an organic polymer-based orifice plate structure showing one of the orifices through the plate in an even further alternative embodiment.

An even further non-limiting embodiment of the claimed invention is illustrated in FIG. 11. Again, all of the information, materials, numerical parameters, functional characteristics, operational features, and other aspects of the embodiments of FIGS. 5–10 are equally applicable to the embodiment of FIG. 11 (except for the particular modifications provided below). The specific information associated with the embodiments of FIGS. 5–10 is therefore incorporated by reference relative to the system of FIG. 11.

Regarding the orifice plate 250 of FIG. 11, it differs from the system of FIGS. 5–6 in a number of ways. First, the orifice plate 250 illustrated in FIG. 11 has been modified regarding the angular relationship between (1) the side wall 270 associated with the recess 262; and (2) the top surface 254 of the orifice plate 250. Specifically, the angle "X" in the embodiment of FIG. 11 has been expanded to exceed 90°, thereby forming an "obtuse" angle. An obtuse angle is again generally defined to involve an angle which is greater than 90°. In particular, the angle "X" employed in a preferred version of the embodiment of FIG. 11 will involve the same characteristics as the angle "X" used in the embodiment of FIG. 8, with the information listed above in connection with the system of FIG. 8 being incorporated by reference relative to the orifice plate 250 of FIG. 11. While the present invention shall not be restricted to any particular obtuse angles in this case, it is preferred that the angle "X" associated with this embodiment be about 100–145° (substantially the same as in FIG. 8) in order to produce the orifice plate 250 shown in FIG. 11. However, as noted above, other values are also applicable in connection with angle "X". For example, if desired, angle "X" could be about 90° (approximately a right angle) or less ("acute") provided that the first opening 272 is larger in size (defined above) than the second opening 282.

The system of FIG. 11 also differs from that of FIGS. 5–6 in another way which will now be discussed. This difference involves the angular relationship between (1) the bottom wall 276 of the recess 262; and (2) the side wall 270 in the recess 262. Specifically, the angle "$X_1$" between both of these components in the specific embodiment of FIG. 11 will be of a value which is sufficient to produce an upwardly extending "crown" structure 300 from which the ink materials (including ink composition 174) will be expelled during operation of the printhead 80. In particular, angle "$X_1$" should be sufficient to cause the bottom wall 276 in the recess 262 to be upwardly sloped as illustrated (to at least some degree) relative to the bottom surface 256 of the orifice plate 250 so that the crown structure 300 can be produced. While this particular version of the invention shall not be restricted to any given angle "$X_1$" (with a number of variations being possible), effective results are achieved if angle "$X_1$" is acute (less than 90°), with a representative and preferred range associated with angle "$X_1$" in the embodiment of FIG. 11 being about 45–80°. However, it shall be understood that angle "$X_1$" may, in fact, be 90° or greater if needed provided that a structure is produced in which the bottom wall 276 is upwardly sloped to at least some degree relative to the bottom surface 256 of the orifice plate 250 as previously noted. As a result, the bottom wall 276 is not parallel to the bottom surface 256 of the orifice plate 250 and forms an upwardly sloped angle relative to the bottom surface 256 in order to generate the crown structure 300.

The overall length/depth of the recess 262 in the orifice plate 250 of FIG. 11 (as measured from the top surface 254 of the plate 250 to the second opening 282) may be adjusted as desired, preferably within the "L" value range previously listed in connection with the system of FIGS. 5–6 or greater if necessary. The desired parameters associated with all of the variables in the present embodiment (with particular reference to "L", "X", and "$X_1$") will again be determined in accordance with routine preliminary pilot testing taking into account a number of items including the other components which will be employed to manufacture the printhead 80, as well as the manner in which the printhead 80 is going to be used. With continued reference to FIG. 11, the first and second openings 272, 282 in this version of the claimed orifice plate 250 will optimally remain substantially the same from a size standpoint relative to the initial embodiment of FIGS. 5–6, although the size values associated with these elements may be modified as needed. Regarding the configuration of the ink transfer bore 286 in FIG. 11, this portion of the orifice 252 may have the features recited above in connection with the embodiments of FIGS. 5–10, with the data associated therewith being incorporated by reference relative to the system of FIG. 11. Finally, the orifice plate 250 of FIG. 11 again provides a number of important benefits including "isolation" and protection of the second opening 282 within the recess 262 in accordance with the "inset" nature of the second opening 282. In addition, the crown structure 300 discussed above provides even further structural integrity in the orifice plate 250.

Notwithstanding the information and parameters recited above in connection with all of the various designs shown in FIGS. 5–11, these multiple embodiments shall not limit the invention in any respect and instead represent different versions of the invention which can provide the desired benefits. Further variations are possible and encompassed within the invention as defined by the claims presented below.

C. Ink Delivery Systems Using the Novel Printheads/Orifice Plates and Fabrication Methods Associated Therewith In accordance with the information provided above, a unique orifice plate 250 and printhead 80 associated therewith having a high degree of durability, longevity, and resistance to the effects of physical engagement with ink wipers and other structures are provided. These benefits are achieved in accordance with the specialized orifice plate 250 having the unique orifice design described above, with the plate 250 being of organic polymer construction. It is a highly desirable and novel aspect of the present invention that all of the foregoing benefits may be achieved using a thin-film polymeric orifice plate 250 of the type discussed herein. Additional benefits associated with this orifice plate 250 are summarized in the previous sections. In addition to the components, features, and novel elements of the orifice plate 250 outlined herein (including the specialized recess 262 employed in connection with the orifices 252 in the plate 250), this invention shall also encompass (1) an "ink delivery system" which is constructed using the claimed printhead 80 having the orifice plate 250 attached thereto; and (2) a novel method for fabricating the printhead 80 which employs the specialized components listed in Sections "A"–"B" above. Accordingly, all of the data in Sections "A"–"B" shall be fully incorporated by reference in the present section (Section "C").

In order to produce the ink delivery system of the invention, an ink containment vessel is provided which is operatively connected to and in fluid communication with the claimed printhead 80 which comprises the novel orifice plate 250 discussed above (including any of the foregoing embodiments as shown in FIGS. 5–11 and others encompassed within the claimed invention). The term "ink containment vessel" as previously defined can involve any type of housing, tank, or other structure designed to hold a supply of ink therein (including the ink composition 174). The terms "ink containment vessel", "housing", "chamber", and "tank" shall all be considered equivalent from a functional and structural standpoint. The ink containment vessel can involve, for example, the housing 12 employed in the self-contained cartridge 10 of FIG. 1 or the housing 172 associated with the "off-axis" system of FIGS. 3–4. Likewise, the phrase "operatively connected" shall encompass a situation in which the claimed printhead 80 (having the novel orifice plate 250 attached thereto) is directly secured to an ink containment vessel as shown in FIG. 1 or remotely connected to an ink containment vessel in an "off-axis" manner as illustrated in FIGS. 3–4. Again, an example of an "on-board" system of the type presented in FIG. 1 is provided in U.S. Pat. No. 4,771,295 to Baker et al., with "off-axis" ink delivery units being described in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 11, 1997) entitled "REGULATOR FOR A FREE-INK INKJET PEN" (Hauck et al.), with all of these items being incorporated herein by reference. These documents describe and support "operative connection" of the claimed printhead (e.g. printhead 80 or 204) to a suitable ink containment vessel, with the data and benefits recited in Sections "A"–"B" again being incorporated by reference in the current section (Section "C"). This data includes representative construction materials, parameters, and the claimed novel features associated with the orifice plate 250, orifice 252, and printheads 80, 204. In this regard, the ink delivery systems of the present invention will include in a preferred embodiment (1) an ink containment vessel which may involve a number of different types as previously discussed; (2) a printhead which comprises a substrate, at least one ink ejector on the substrate (with many different ink ejectors being suitable for use including but not limited to one or more resistor elements); and (3) a novel orifice plate member positioned over and above the substrate. The orifice plate will have the characteristics and features outlined in all of the embodiments presented herein (see FIGS. 5–11) and any other embodiments encompassed within the claimed invention as previously noted. The resulting ink delivery system provides all of the previously-listed benefits including but not limited to improved durability and the maintenance of proper ink drop trajectory over the life of the printhead.

Regarding the claimed method for producing the novel printhead 80 of the present invention, a specialized orifice plate member (namely, orifice plate 250) is provided which includes the structures, components, and features recited above and shown in FIGS. 5–11. In this regard, all of the information presented in Sections "A"–"B" regarding the novel orifice plate 250 is again applicable to the claimed method and is incorporated in this section (Section "C") by reference. A substrate 82 having at least one ink ejector thereon (preferably a resistor 86) is likewise provided. The components which may be employed in connection with the substrate 82 and ink ejector shall likewise be of the general types discussed above in Sections "A"–"B". It should also be noted that the claimed methods, devices, and systems shall not be exclusively restricted to the representative components outlined in Sections "A"–"B" and shall not be limited to the structural configurations of the novel orifice plate 250 which are presented in FIGS. 5–11. Instead, the present invention shall encompass any and all modifications, variations, and equivalents which are appropriately encompassed with the claims listed below.

Once the substrate 82 and ink ejector have been provided, the novel orifice plate member 250 (having the specialized recess 262 therein) is fixedly secured in position over and above the substrate 82 in order to produce the completed printhead 80. Representative methods for attaching these components together are recited in Section "A" above. Suitable techniques for accomplishing these goals include the use of various adhesives to secure the orifice plate 250 in position (against the underlying ink barrier layer 156) or by self-adhesion of the orifice plate 250 as previously indicated. Regarding adhesive materials, Section "A" discusses the ink barrier layer 156 (which is shown in FIG. 2), along with the placement of an adhesive layer 164 thereon for adhering the barrier layer 156 to the overlying orifice plate 250. The adhesive layer 164 may involve a number of different compositions as previously discussed. Representative adhesive materials suitable for this purpose include commercially available epoxy resin and cyanoacrylate compounds known in the art. Likewise, the adhesive layer 164 may involve the use of uncured poly-isoprene photoresist compounds as recited in U.S. Pat. No. 5,278,584, as well as (1) polyacrylic acid; and/or (2) a selected silane coupling agent. The term "polyacrylic acid" shall be conventionally defined to involve a compound having the following basic chemical structure $[CH_2CH(COOH)_n]$ wherein n=25–10,000. Polyacrylic acid is commercially available from numerous sources including but not limited to the Dow Chemical Corporation of Midland, Mich. (U.S.A.). Representative silane coupling agents which are suitable for use herein include but are not limited to commercial products sold by the Dow Chemical Corporation of Midland, Mich. (U.S.A.) [product nos. 6011, 6020, 6030, and 6040], as well as OSI Specialties of Danbury, Conn. (U.S.A.) [product no. "Silquest" A-1100]. However, the above-listed materials are again provided for example purposes only and shall not limit the invention in any respect.

The adhesive layer 164 is specifically used to attach/secure the orifice plate 250 (or any other orifice plates encompassed within the claimed invention) to and within the printhead 80 so that it is fixedly secured in position over and above the substrate 82 having the ink ejectors (resistors 86) thereon. It is again important to note that the use of a separate adhesive layer 164 may, in fact, not be necessary if the top of the barrier layer 156 can be made adhesive in some manner (e.g. if it consists of a material which, when heated, becomes pliable with adhesive characteristics). Accordingly, the present invention shall not be restricted to any particular methods, techniques, or materials for assembling the printhead 80 with particular reference to attachment of the orifice plate 250 to the underlying components of the printhead 80.

Finally, some additional information is warranted regarding formation of the orifice 252 described above including the novel recess 262 (all embodiments) and ink transfer bore 286 thereunder. Many different methods known in the art for forming openings in plastics/polymers and the like may be employed for this purpose without limitation including but not limited to laser ablation techniques, chemical etching methods, and the use of standard mechanical drilling/boring instruments. Such instruments would be specifically contoured and otherwise configured to produce the desired designs associated with the recess 262 and ink transfer bore 286 in each of the claimed orifices 252. Regarding the use of laser ablation techniques, the methods described in U.S. Pat. Nos. 5,305,015 and 5,278,584 shall be considered applicable and incorporated herein by reference. Specifically, a mask structure initially created using standard lithographic techniques is employed for this purpose. A laser system of conventional design is then selected which, in a preferred embodiment, involves an excimer laser of a type selected from the following alternatives: $F_2$, ArF, KrCl, KrF, or XeCl. Using this particular system (along with preferred pulse energies of greater than about 100 millijoules/$cm^2$ and pulse durations shorter than about 1 microsecond), the orifices 252 and structures associated therewith (e.g. the recesses 262/ink transfer bores 286) can be formed with a high degree of accuracy, precision, and control. However, the claimed invention shall not be limited to any particular fabrication method, with other methods also being suitable for producing the completed orifice plate 250/orifices 252 including conventional ultraviolet ablation processes (e.g. using ultraviolet light in the range of about 150–400 nm), as well as standard chemical etching, stamping, reactive ion etching, ion beam milling, and comparable known processes.

In conclusion, the present invention involves a novel printhead structure and specialized orifice plate which are characterized by many benefits. These benefits again include (1) a substantial increase in printhead/orifice plate longevity; (2) the ability to maintain precise control over ink drop trajectory; (3) compatibility of the claimed orifice plate with printing units which employ a variety of different wiper systems that are used to clean the printhead; (4) the avoidance of premature damage to the orifice plate, notwithstanding its thin-film plastic/polymeric character; (5) the ability to provide a high-durability thin-film polymeric orifice plate structure which can maintain its light and thin profile while avoiding the problems discussed above; and (6) the accomplishment of these goals using a technique which avoids the deposition of additional material layers and/or chemical compositions onto the orifice plate. Having herein set forth preferred embodiments of the invention, it is anticipated that suitable modifications may be made thereto by individuals skilled in the relevant art which nonetheless remain within the scope of the invention. For example, the invention shall not be limited to any particular ink delivery systems, operational parameters, numerical values, dimensions, ink compositions, and component orientations within the general guidelines set forth above unless otherwise stated herein.

The present invention shall therefore only be construed in accordance with the following claims:

1. A printhead for use in an ink delivery system comprising:

a substrate comprising at least one ink ejector thereon; and an orifice plate member comprised of at least one organic polymer composition positioned over and above said substrate, said orifice plate member further comprising:

a top surface;

a bottom surface;

at least one recess in said orifice plate member beginning at said top surface thereof and terminating at a position within said orifice plate member between said top surface and said bottom surface thereof, said recess having a depth of about 1 $\mu$m and comprising an upper end, a lower end, and a side wall therebetween, said upper end comprising a first opening therein and said lower end comprising a bottom wall therein, said bottom wall comprising a second opening therethrough, said first opening being larger than said second opening, said bottom wall being oriented at an obtuse angle of about 100° relative to said side wall of said recess; and at least one ink transfer bore in fluid communication with said recess, said bore beginning at said lower end of said recess and terminating at said bottom surface of said orifice plate member.

* * * * *